US010500854B2

(12) United States Patent
Condie et al.

(10) Patent No.: US 10,500,854 B2
(45) Date of Patent: Dec. 10, 2019

(54) DROPLET DEPOSITION HEAD AND ACTUATOR COMPONENT THEREFOR

(71) Applicant: XAAR TECHNOLOGY LIMITED, Cambridgeshire (GB)

(72) Inventors: Angus Condie, Cambridge (GB); Nicholas Marc Jackson, Cambridge (GB); Simon James Hubbard, Bedfordshire (GB)

(73) Assignee: XAAR TECHNOLOGY LIMITED, Cambridgeshire (GB)

( * ) Notice: Subject to any disclaimer, the term of this patent is extended or adjusted under 35 U.S.C. 154(b) by 0 days.

(21) Appl. No.: 16/068,781

(22) PCT Filed: Dec. 30, 2016

(86) PCT No.: PCT/GB2016/054095
§ 371 (c)(1),
(2) Date: Jul. 9, 2018

(87) PCT Pub. No.: WO2017/118843
PCT Pub. Date: Jul. 13, 2017

(65) Prior Publication Data

US 2019/0023013 A1 Jan. 24, 2019

(30) Foreign Application Priority Data

Jan. 8, 2016 (GB) ..... 1600332.9

(51) Int. Cl.
*B41J 2/14* (2006.01)
*B41J 2/045* (2006.01)

(52) U.S. Cl.
CPC ..... *B41J 2/14209* (2013.01); *B41J 2/0453* (2013.01); *B41J 2/04525* (2013.01);
(Continued)

(58) Field of Classification Search
CPC ... B41J 2/14209; B41J 2/0453; B41J 2/04525
See application file for complete search history.

(56) References Cited

U.S. PATENT DOCUMENTS 4,992,808 A 2/1991 Bartky et al.
5,548,313 A 8/1996 Lee
(Continued)

FOREIGN PATENT DOCUMENTS

EP 1779445 A2 5/2007
EP 2905138 A1 8/2015
(Continued)

OTHER PUBLICATIONS

Search Report and Written Opinion in International Application No. PCT/GB2016/054095 dated Apr. 10, 2017.
(Continued)

*Primary Examiner* — Julian D Huffman
(74) *Attorney, Agent, or Firm* — Marshall, Gerstein & Borun LLP

(57) ABSTRACT

An actuator component for a droplet deposition head that includes: a plurality of fluid chambers arranged side-by-side in an array, with certain of the fluid chambers being firing chambers, each of which is provided with at least one piezoelectric actuating element for causing droplet ejection from a nozzle for that firing chamber; and a plurality of non-actuable walls, each of which is formed of piezoelectric material and bounds at least one of the firing chambers.

20 Claims, 15 Drawing Sheets

(52) U.S. Cl.
CPC ..... *B41J 2/04581* (2013.01); *B41J 2/14233* (2013.01); *B41J 2002/14241* (2013.01); *B41J 2002/14491* (2013.01)

(56) References Cited

U.S. PATENT DOCUMENTS

| | | | | |
|---|---|---|---|---|
| 6,106,106 | A * | 8/2000 | Nakazawa | B41J 2/14209 347/68 |
| 6,203,144 | B1 | 3/2001 | Zhang | |
| 6,223,405 | B1 | 5/2001 | Oikawa et al. | |
| 2002/0140780 | A1 | 10/2002 | Igaki et al. | |
| 2003/0011660 | A1* | 1/2003 | Nishi | B41J 2/14209 347/68 |
| 2008/0204509 | A1 | 8/2008 | Drury | |
| 2013/0050338 | A1* | 2/2013 | Shimosato | B41J 2/14209 347/40 |
| 2015/0239247 | A1 | 8/2015 | Kato | |

FOREIGN PATENT DOCUMENTS

| | | | |
|---|---|---|---|
| JP | 8-192515 | | 7/1996 |
| WO | WO-0024584 | A1 | 5/2000 |
| WO | WO-00/38928 | A1 | 7/2000 |
| WO | WO-01/49493 | A2 | 7/2001 |
| WO | WO-03022587 | A1 | 3/2003 |
| WO | WO-2006/005952 | A2 | 1/2006 |
| WO | WO-2006/015378 | A2 | 2/2006 |

OTHER PUBLICATIONS

Search Report in GB Application No. 1600332.9 dated Jul. 8, 2016, 1 page.

* cited by examiner

DROPLET DEPOSITION HEAD AND ACTUATOR COMPONENT THEREFOR

The present invention relates to droplet deposition heads and actuator components therefor. It may find particularly beneficial application in a printhead, such as an inkjet printhead, and actuator components therefor.

Droplet deposition heads are now in widespread usage, whether in more traditional applications, such as inkjet printing, or in 3D printing, or other materials deposition or rapid prototyping techniques. Accordingly, the fluids may have novel chemical properties to adhere to new substrates and increase the functionality of the deposited material.

Recently, inkjet printheads have been developed that are capable of depositing ink directly onto ceramic tiles, with high reliability and throughput. This allows the patterns on the tiles to be customized to a customer's exact specifications, as well as reducing the need for a full range of tiles to be kept in stock.

In other applications, inkjet printheads have been developed that are capable of depositing ink directly on to textiles. As with ceramics applications, this may allow the patterns on the textiles to be customized to a customer's exact specifications, as well as reducing the need for a full range of printed textiles to be kept in stock.

In still other applications, droplet deposition heads may be used to form elements such as color filters in LCD or OLED elements displays used in flat-screen television manufacturing.

So as to be suitable for new and/or increasingly challenging deposition applications, droplet deposition heads continue to evolve and specialize. However, while a great many developments have been made, there remains room for improvements in the field of droplet deposition heads.

SUMMARY

Aspects of the invention are set out in the appended claims.

BRIEF DESCRIPTION OF THE DRAWINGS

The invention will now be described with reference to the drawings, in which.

DETAILED DESCRIPTION OF THE DRAWINGS

Figure 1A:
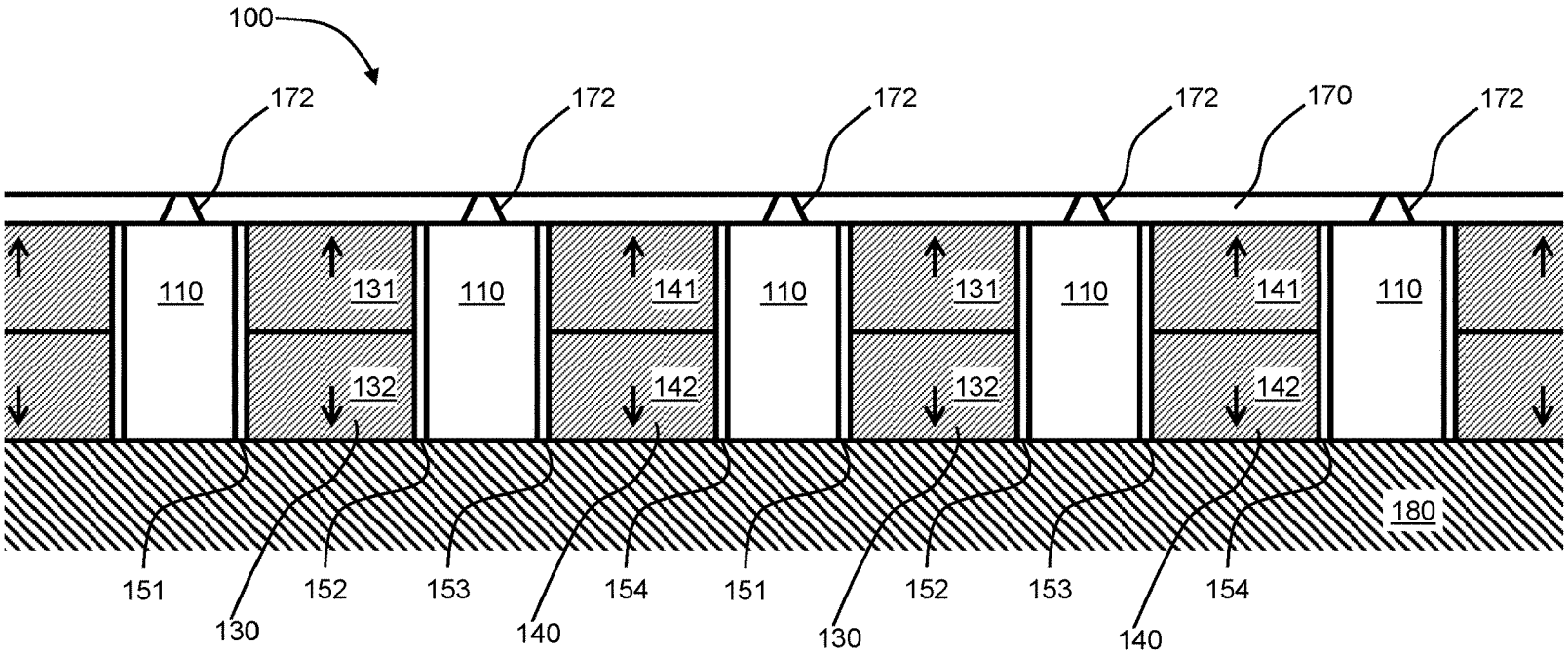
FIG. 1A is a cross-sectional view of an actuator component for a droplet deposition head according to a first example embodiment.

In general, the following disclosure relates to actuator components for droplet deposition heads that include a plurality of fluid chambers arranged side-by-side in an array. At least some of the fluid chambers in the array are firing chambers, each of which is provided with at least one piezoelectric actuating element and a nozzle.

In one aspect, the following disclosure describes an actuator component for a droplet deposition head comprising: a plurality of fluid chambers arranged side-by-side in an array, which extends in an array direction, at least some of said fluid chambers being firing chambers, each of which is provided with at least one piezoelectric actuating element and a nozzle, said at least one piezoelectric actuating element being actuable to cause droplet ejection from said nozzle; a plurality of non-actuable walls, each of which comprises piezoelectric material and bounds, in part, at least one of said firing chambers; wherein each of said piezoelectric actuating elements is provided with at least a first and a second actuation electrode, the first and second actuation electrodes for each piezoelectric actuating element being configured to apply a drive waveform to that piezoelectric actuating element, which is thereby deformed, thus causing droplet ejection; wherein each of said non-actuable walls is provided with at least a first and a second isolated electrode, the first and second isolated electrodes for each non-actuable wall being electrically isolated so that, when fluid within one of the at least one of said firing chambers bounded by that non-actuable wall applies a force to that non-actuable wall, a charge is induced in the isolated electrodes, thereby causing the piezoelectric material of that non-actuable wall to apply a force in opposition to the fluid force.

The following disclosure also describes droplet deposition heads comprising such actuator components. Such droplet deposition heads may further comprise one or more manifold components that are attached to the actuator component. The manifold component(s) may convey fluid to the fluid chambers within said array. In some examples, such manifold component(s) may also receive fluid from the fluid chambers within said array. Such droplet deposition heads may, in addition, or instead, include drive circuitry that is electrically connected to the actuating elements, for example by means of electrical traces provided by the actuator component. Such drive circuitry may supply drive voltage signals to the actuating elements that cause the ejection of droplets from a selected group of chambers, with the selected group changing with changes in input data received by the head.

It should be appreciated that a variety of alternative fluids may be deposited by a droplet deposition head. For instance, a droplet deposition head may eject droplets of ink that may travel to a sheet of paper or card, or to other receiving media, such as ceramic tiling or shaped articles (e.g. cans, bottles etc.), to form an image, as is the case in inkjet printing applications (where the droplet deposition head may be an inkjet printhead or, more particularly, a drop-on-demand inkjet printhead).

Alternatively, droplets of fluid may be used to build structures, for example electrically active fluids may be deposited onto receiving media such as a circuit board so as to enable prototyping of electrical devices.

In another example, polymer containing fluids or molten polymer may be deposited in successive layers so as to produce a prototype model of an object (as in 3D printing).

In still other applications, droplet deposition heads might be adapted to deposit droplets of solution containing biological or chemical material onto a receiving medium such as a microarray.

Droplet deposition heads suitable for such alternative fluids may be generally similar in construction to printheads, with some adaptations made to handle the specific fluid in question.

Droplet deposition heads as described in the following disclosure may be drop-on-demand droplet deposition heads. In such heads, the pattern of droplets ejected varies in dependence upon the input data provided to the head.

Turning now to FIG. 1A, there is shown a cross-sectional view of an actuator component 100 for a droplet deposition head according to a first example embodiment. As may be seen from the drawing, the actuator component 100 of FIG. 1A includes a plurality of fluid chambers 110 arranged side-by-side in an array. This array extends from left to right in FIG. 1A. As FIG. 1A shows, each of the fluid chambers 110 is provided with a nozzle 172, from which fluid contained within the chamber 110 may be ejected, in a manner that will be described below. Accordingly, all of the fluid chambers 110 in FIG. 1A may be characterized as being "firing" chambers. Each of the fluid chambers 110 is elongate in a chamber length direction, which is into the page in FIG. 1A.

Figure 1B:
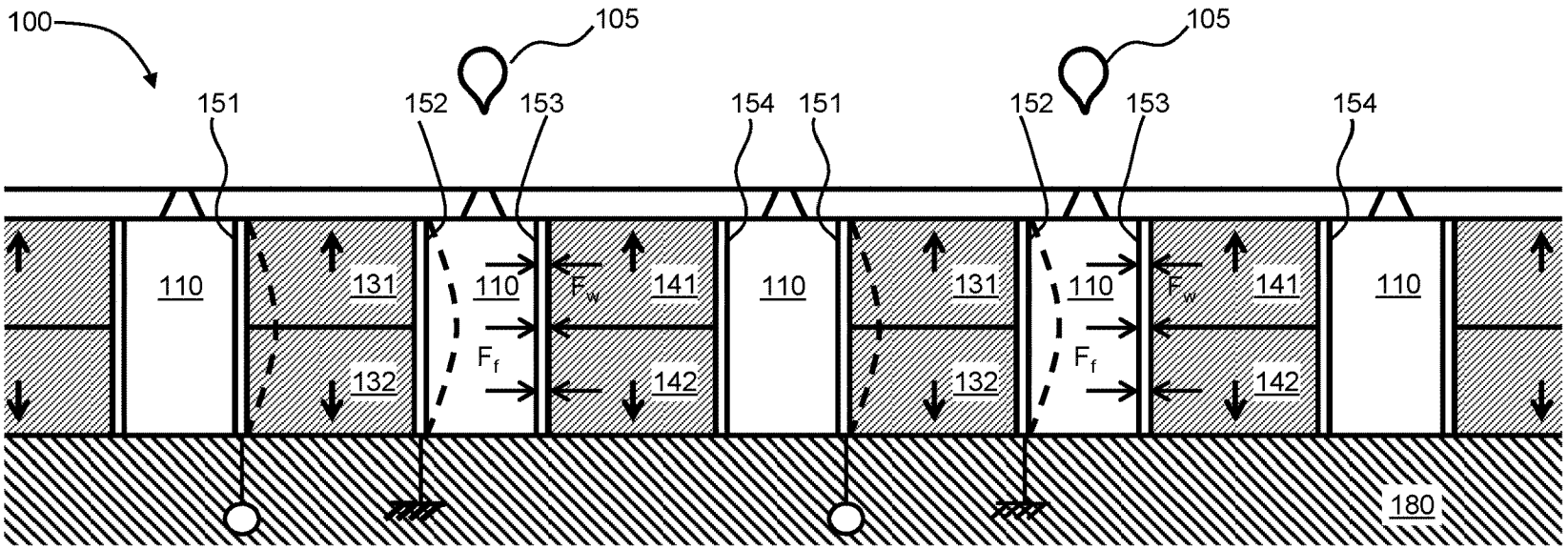
FIG. 1B is a further cross-sectional view of the actuator component of FIG. 1A that illustrates the application of drive waveforms to actuable walls of the actuator component.

In the embodiment of FIGS. 1A and 1B, adjacent chambers 110 within the array are separated by chamber walls 130, 140 which are formed of piezoelectric material (such as lead zirconate titanate (PZT), however any suitable piezoelectric material may be used). Such a construction may, for example, be provided by forming, for instance by sawing, an array of elongate channels side-by-side in a surface of a planar body of piezoelectric material.

As will be discussed in greater detail below, the actuator component 100 of FIGS. 1A and 1B includes two types of walls 130, 140: actuable walls 130, which may be actuated to cause droplet ejection; and non-actuable walls 140, which cannot be actuated. As may be seen from FIG. 1A, the actuable walls 130 are provided alternately with the non-actuable 140 walls in the array direction.

In the actuator component 100 of FIGS. 1A and 1B, one longitudinal side of each of the fluid chambers 110 is bounded (at least in part) by a nozzle plate 170, which provides a nozzle 172 for each of the firing chambers 110. In this way, each nozzle 172 is provided in one longitudinal side of the corresponding one of the firing chambers 130. It will be appreciated that other approaches may achieve this as well: a separate nozzle plate 170 component is not required in order that each nozzle 172 is provided in one longitudinal side of the corresponding one of the firing chambers 130.

The other, opposing, longitudinal side of each of the fluid chambers 110 is bounded (at least in part) by a substrate 180 which may, for example, be substantially planar. In some arrangements, the substrate 130 may be integral with a part of, or all of, each of the walls 130. Hence (or otherwise) the substrate 180 may be formed of piezoelectric material. It should also be appreciated that an interposer layer could be provided between the walls 130 and the nozzle plate 170; this interposer layer may, for example, provide a respective aperture for each of the nozzles 172 of the nozzle plate. Such apertures will typically be wider than the nozzles 172, so that the fluid contacts only the nozzles 172 during droplet ejection.

In the actuator component 100 of FIGS. 1A and 1B, each actuable wall 130 is provided with a first electrode 151 and a second electrode 152. The first electrode 151 is disposed on a first side surface of the actuable wall 130, which faces towards one of the two fluid chambers 110 that the actuable wall 130 in question separates, whereas the second electrode 152 is disposed on a second side surface of the actuable wall 130, which is opposite the first side surface and faces towards the other of the two fluid chambers 110 that the actuable wall 130 in question separates.

The first 151 and second 152 electrodes for the actuable wall 130 are configured to apply a drive waveform to the actuable wall 130 and may therefore be characterized as actuation electrodes. As illustrated with exaggerated dashed-lines in FIG. 1B, which is a further cross-sectional view of the actuator component 100 of FIG. 1A, application of this drive waveform to an actuable wall 130 may cause that actuable wall 130 to deform towards one of the two fluid chambers 110 separated by that actuable wall 130, with this deformation causing an increase in the pressure of the fluid within that one of the two fluid chambers 110. The deformation also causes a corresponding reduction in the pressure of the other one of the two fluid chambers 110. It will be appreciated that a drive waveform of opposite polarity will cause the actuable wall 130 to deform in the opposite direction, thus having substantially the opposite effect on the pressure of the fluid within the two chambers 110 separated by the actuable wall 130.

FIGS. 1A and 1B further illustrate, with arrows, the direction(s) in which the piezoelectric material of each actuable wall 130 is poled. As may be seen, the first 151 and second 152 actuation electrodes for each of the actuable walls 130 are spaced apart in a direction (specifically, the array direction) that is perpendicular to the direction in which the piezoelectric material is poled. Hence (or otherwise), when a drive waveform is applied to the actuable wall 130 by the first 151 and second 152 actuation electrodes, it will deform in shear mode.

As may be seen from FIGS. 1A and 1B, each actuable wall 130 includes a first portion 131 and a second portion 132, with the piezoelectric material of the first portion 131 being poled in an opposite direction to the piezoelectric portion of the second portion 132. As may also be seen, the poling direction of each of the first portion 131 and the second portion 132 is perpendicular to the array direction and to the chamber length direction. The first 131 and second 132 portions are separated by a plane defined by the array direction and the chamber length direction.

As a result of the arrangement of the first 131 and second 132 portions and their different poling directions, when a drive waveform is applied to the actuable wall 130 by the first 151 and second 152 actuation electrodes, the actuable wall 130 deforms in a chevron configuration, whereby the first 131 and second 132 portions deform in shear mode in opposite senses, as is shown in dashed-line in FIG. 1B.

It should of course be appreciated that deformation in chevron configuration may be achieved with different arrangements of the actuable wall 130 and the first 151 and second 152 actuation electrodes. For example, the piezoelectric material of the actuable wall may be poled substantially in only one direction. In a specific example, it may be poled substantially only in a wall height direction, which is perpendicular to the array direction and to the chamber length direction. In such cases, the first 151 and second 152 actuation electrodes may, for instance, be arranged such that they extend over only a portion of the height of the actuable wall 130 in this height direction (more particularly, they may extend over substantially the same portion of the height of the actuable wall 130 in this height direction).

As is also shown in FIG. 1B, where the magnitude of the pressure exceeds a certain level, droplets of fluid 105 will typically be ejected from the nozzle 172 of a chamber 110. The actuable wall 130 may be driven by the drive waveform such that it deforms alternately toward one of the two fluid chambers 110 it separates and toward the other. Thus, the actuable wall 130 of the actuator component 100 of FIG. 1 may be caused by the drive waveform to oscillate about its undeformed position (though it will be appreciated that such cyclical deformation is by no means essential: the drive waveform could instead cause non-cyclical deformations of the actuable wall).

Hence, or otherwise, droplets may be ejected alternately by each one of the pair of firing chambers 110 separated by the actuable wall 130. With a suitable drive waveform this may lead, for example, to one of the pair of firing chambers 110 ejecting N droplets, and the other of the pair of firing chambers 110 ejecting M droplets, where N differs from M by at most 1. More particularly, the drive waveform may cause the actuable wall 130 of the pair of firing chambers 110 to be actuated such that an equal number of droplets is ejected by each of the firing chambers 110 (i.e. N is equal to M).

Hence, or otherwise, the firing chambers 110 may thus be considered as being actuated in pairs. The input data for the droplet deposition head of which the actuator component 100 forms a part may be processed accordingly, for example with a suitable screening algorithm.

As is also illustrated in FIG. 1B, each first actuation electrode 151 may be electrically connected, for example by a respective conductive trace, to an electrical connector, so as to receive a voltage signal. Each second actuation electrode 152 may be electrically connected, for example by a respective conductive trace, to ground. In this way, a drive waveform may be applied to each actuable wall 130, using the corresponding first 151 and second 152 actuation electrodes.

However, it should be apparent that different arrangements may be utilized to apply a drive waveform to each actuable wall 130 using the corresponding first 151 and second 152 actuation electrodes. In one example, each first actuation electrode 151 and each second actuation electrode 152 may be connected by a respective conductive trace so as to receive a respective voltage signal. In another example, rather than the second actuation electrodes 152 being electrically connected to ground, they may be connected to a common voltage signal.

As may also be seen from FIGS. 1A and 1B, each non-actuable wall 140 is similarly provided with a first electrode 153 and a second electrode 154. The first electrode 153 is disposed on a first side surface of the non-actuable wall 140, which faces towards one of the two fluid chambers 110 that the non-actuable wall 140 in question separates, whereas the second electrode 154 is disposed on a second side surface of the non-actuable wall 140, which is opposite the first side surface and faces towards the other of the two fluid chambers 110 that the non-actuable wall 140 in question separates.

In contrast to the first 151 and second 152 actuation electrodes, the first 153 and second 154 electrodes of the non-actuable walls 140 are electrically isolated. They may thus be characterized as isolated electrodes.

The first 153 and second 154 isolated electrodes may more particularly be isolated from each other. In addition, they may be electrically isolated from the traces that connect the actuation electrodes 151, 152 to voltage signals, or to ground.

As discussed above with reference to FIG. 1B, the actuation electrodes 151, 152 are configured to apply a drive waveform to the actuable walls 130, which are thereby deformed. As a result, the droplet deposition head 100 is able to increase the pressure of the fluid within selected firing chambers 110, hence causing droplet ejection from these selected chambers. This selection may vary in dependence upon the input data received by the droplet deposition head of which the actuator component 100 forms a part. Each of the actuable walls 130 therefore acts as a piezoelectric actuating element.

It may therefore be appreciated that the actuable walls 130 utilize the reverse piezoelectric effect, where the application of an electric field to an element formed of piezoelectric material causes the crystalline structure of the piezoelectric material to change shape, thus producing dimensional changes in the piezoelectric element.

When the pressure of the fluid within a chamber is increased (or decreased), whether as a result of the action of the actuable walls 130, or otherwise, the fluid will generally apply a corresponding fluid force ($F_f$) to the walls of the chamber. When such a fluid force is applied to a non-actuable wall 140, as a result of the electrical isolation of the isolated electrodes 153, 154, a charge is induced in each of the isolated electrodes 153, 154. These induced charges, because they cannot leave the isolated electrodes 153, 154, result in an electric field being applied to the non-actuable wall 140, which in turn causes the piezoelectric material of the non-actuable wall 140 to apply a force ($F_w$) in opposition to the fluid force.

It may therefore be appreciated that, in contrast to the actuable walls 130, the non-actuable walls 140 utilize the direct piezoelectric effect. This is where the application of mechanical pressure to an element formed of piezoelectric material causes the crystalline structure of the piezoelectric material to produce a voltage proportional to the pressure.

In the situation illustrated in FIG. 1B, the force ($F_w$) produced by the non-actuable walls 140 in opposition to the fluid force ($F_f$) may result in less pressure being transmitted from the fluid chamber on one side of the non-actuable wall 140 to the fluid chamber on the other side of the non-actuable wall 140.

The non-actuable walls 140 may be "stiffer", as a result of the provision of the isolated electrodes 153, 154. As a result, the non-actuable walls 140 may not transmit significant forces to the surrounding portions of the actuator component 100, such as the substrate 180, or the nozzle plate 170.

This may, for example, mean that there is less interference or "crosstalk" between neighboring or nearby firing chambers 110 when they are actuated at the same time (or substantially the same time) to eject droplets.

The non-actuable walls 140 may be made stiffer still by forming them with a thickness in the array direction that is greater than that of the actuable walls 130 and/or by forming the isolated electrodes 153, 154 with greater thickness than the actuation electrodes 151, 152.

It should be appreciated that a droplet deposition head of which the actuator component 100 forms a part may additionally include various other components. For instance, such droplet deposition heads may include one or more manifold components that are attached to the actuator component and that convey fluid to the fluid chambers within the array. Such manifold components typically connect to a fluid supply system (e.g. an ink supply system in the case where the head is an inkjet printhead). Use might be made, for instance, of the manifold components taught in WO00/24584, WO00/38928, WO01/49493, or WO03/022587.

In some examples, manifold component(s) might supply fluid at only one longitudinal end of each chamber (in which case, the other end could be sealed) or they may supply fluid at both ends. Furthermore, manifold component(s) may receive fluid from the fluid chambers within said array; for instance, the manifold component(s) may supply fluid to one longitudinal end of each chamber and receive fluid from the other longitudinal end.

Such droplet deposition heads may, in addition (or perhaps instead), include drive circuitry (for instance in the form of one or more integrated circuits, such as ASICs) that is electrically connected to the actuating elements, for example by means of electrical traces provided by the actuator component. Such drive circuitry may supply drive voltage signals to the actuating elements that cause the ejection of droplets from a selected group of chambers, with the selected group changing with changes in input data received by the head.

Figure 2A:
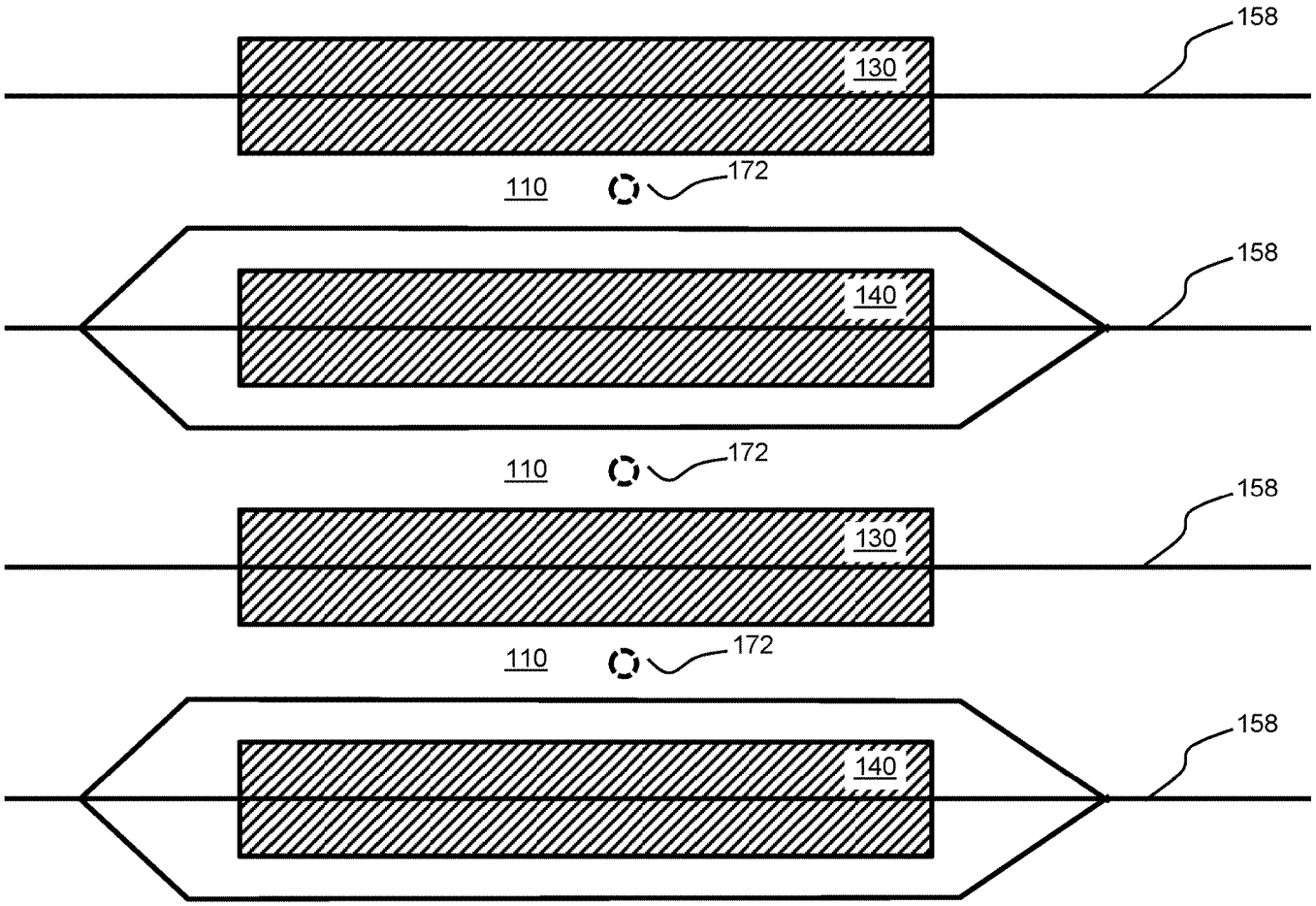
FIG. 2A is a plan view of the actuator component shown in FIGS. 1A and 1B that illustrates a process by which it is possible to form the actuation electrodes of the actuator component using a laser beam.

FIG. 2A is a plan view of the actuator component 100 shown in FIGS. 1A and 1B, taken from the side opposite the substrate 180 in a direction perpendicular to the array direction and the chamber length direction; the nozzle plate 170 is not shown for clarity. The nozzles 172, however, are shown in dashed-line, so as to illustrate their positions: each is located approximately mid-way along the length of the corresponding one of the fluid chambers 110. During use of the droplet deposition head of which the actuator component 100 forms a part, there may be established a flow from one longitudinal end of each of the fluid chambers 110 to the other longitudinal end. Apertures may be provided within substrate 180 so as to provide fluid communication to one or more fluid manifold components.

Where there is a flow along the length of each of the fluid chambers 110, a first group of such apertures may be provided within the substrate 180 to one side of the array of fluid chambers 110 with respect to the chamber length direction, with a second group of such apertures being provided within to the other side of the array of fluid chambers 110 with respect to the chamber length direction. The first group of apertures may provide a fluid connection to an inlet manifold and the second group of apertures may provide a fluid connection to an outlet manifold.

FIG. 2A additionally illustrates a process by which it is possible to form the actuation electrodes 151, 152, the isolated electrodes 153, 154 and conductive traces 155, 156, suitable for electrically connecting the actuation electrodes 151, 152 to ground or to voltage signals.

In more detail, prior to attaching the nozzle plate 170 to the actuable 130 and non-actuable 140 walls, a continuous layer of conductive material is deposited, for example simultaneously, over the surface of the substrate 180 and also over surfaces of the fluid chambers.

Appropriate electrode materials may include Copper, Nickel, Aluminum and Gold, either used alone or in combination. The deposition may be carried out by an electroplating process, such as electroless processes (for example utilizing palladium catalyst to provide the layer with integrity and to improve adhesion to the piezoelectric material), or by physical vapor deposition processes.

Figure 2B:
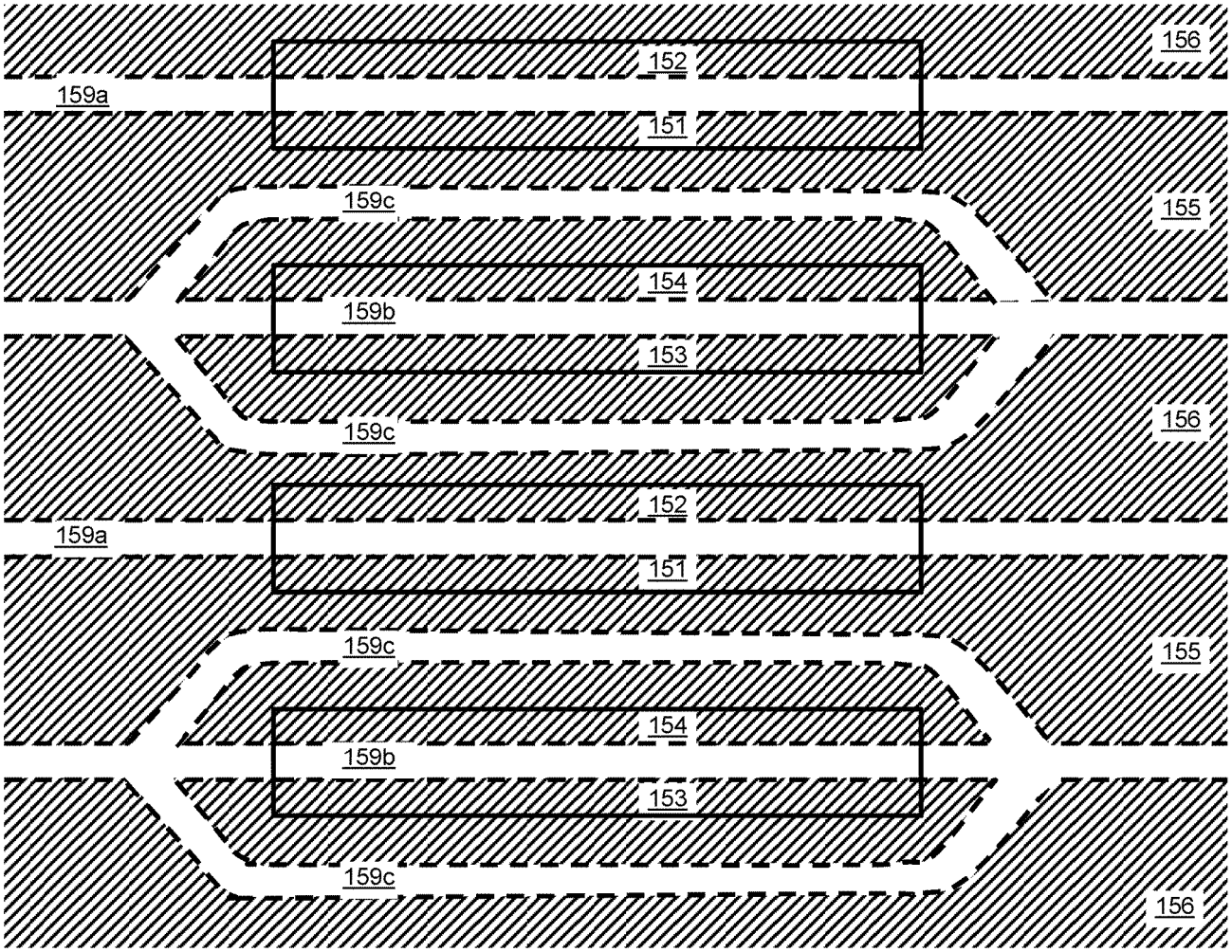
FIG. 2B is a further plan view of the actuator component shown in FIGS. 1A and 1B that illustrates the patterning of conductive material that results from the use of a laser beam in the manner shown in FIG. 2A.

Subsequently, a laser beam is directed at the workpiece including the substrate 180 and the actuable 130 and non-actuable 140 walls. The laser is then moved so that the point where its beam impacts the workpiece moves along the path 158 indicated in FIG. 2A, vaporizing conductive material along this path. The action of the laser beam results in the conductive material being patterned as illustrated in FIG. 2B. As may be seen in the drawing, conductive material has been removed along a number of paths.

Members of a first group of these paths 159*a* each extend in a direction parallel to the chamber length direction along the top surface (that which faces the nozzle plate 170) of a respective one of the actuable walls 130. This has the effect of dividing the conductive material present on the surfaces of each actuable wall 130 into first 151 and second 152 actuation electrodes for that actuable wall 130. It will be appreciated that the conductive material, and thus each of the actuation electrodes 151, 152, extends over the side surfaces (those which face towards the fluid chambers 110 that the actuable wall separates) of the actuable wall 130.

Members of a second group of paths 159*b* similarly each extend in a direction parallel to the chamber length direction, but extend along the top surface (that which faces the nozzle plate 170) of a respective one of the non-actuable walls 140. This has the effect of dividing into two portions the conductive material present on the surfaces of each non-actuable wall 140. Members of a third group of paths 159*c* each encircle a respective one of the non-actuable walls 140, thus isolating the conductive material present on the non-actuable walls from other conductive material present on the substrate 180. Together, the second 159*b* and third 159*c* groups of paths provide the first 153 and second 154 isolated electrodes for each non-actuable wall 140. It will be appreciated that the conductive material, and thus each of the isolated electrodes 153, 154, extends over the side surfaces (those which face towards the fluid chambers 110 that the non-actuable wall 140 separates) of the non-actuable wall 140.

As may be seen from FIG. 2B, each of the paths belonging to the first 159*a* and second 159*b* groups continues over the substrate away from the actuable 130 and non-actuable 140 walls. This results in the conductive material on substrate 180 being separated into first 155 and second 156 traces, which extend respectively from the first 151 and second 152 actuation electrodes. As detailed above, these first 155 and second 156 traces may electrically connect the actuation electrodes 151, 152 to ground or to voltage signals.

It will of course be appreciated that other patterning techniques might be utilized to provide such electrodes and conductive traces. In one example, an appropriate mask might be provided prior to the deposition of the layer of conductive material. In another example, conductive material might be removed by etching, with the pattern of such etching being defined using photolithographic techniques.

As noted above, in the actuator component 100 shown in FIGS. 1 and 2, each of the nozzles 172 is provided in one longitudinal side of the corresponding one of the firing chambers 110. However, it will be appreciated that it is not essential that the nozzles 172 are so-located.

Figure 3A:
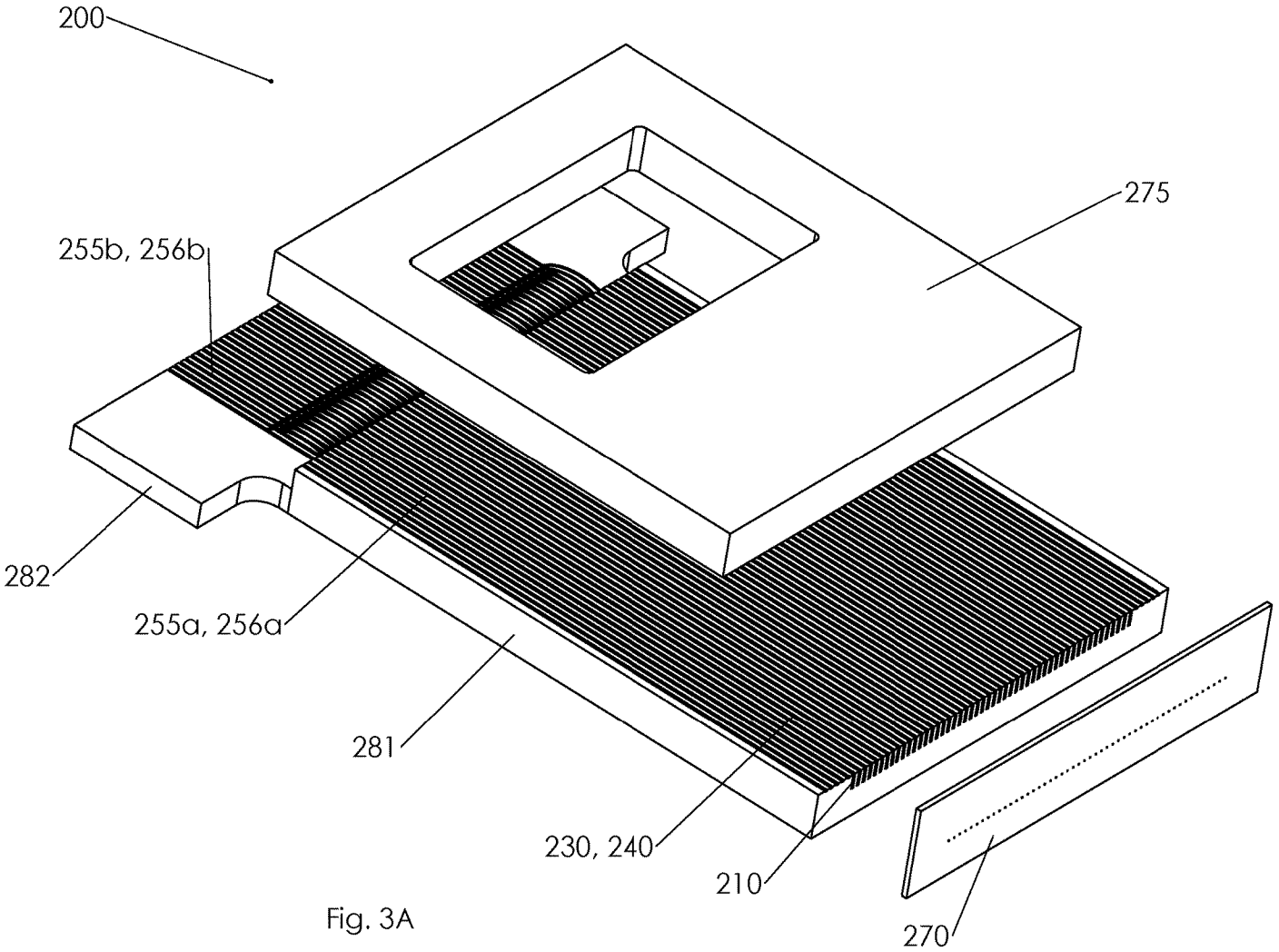
FIG. 3A shows an exploded view in perspective of an actuator component for a droplet deposition head according to a further example embodiment.
Figure 3B:
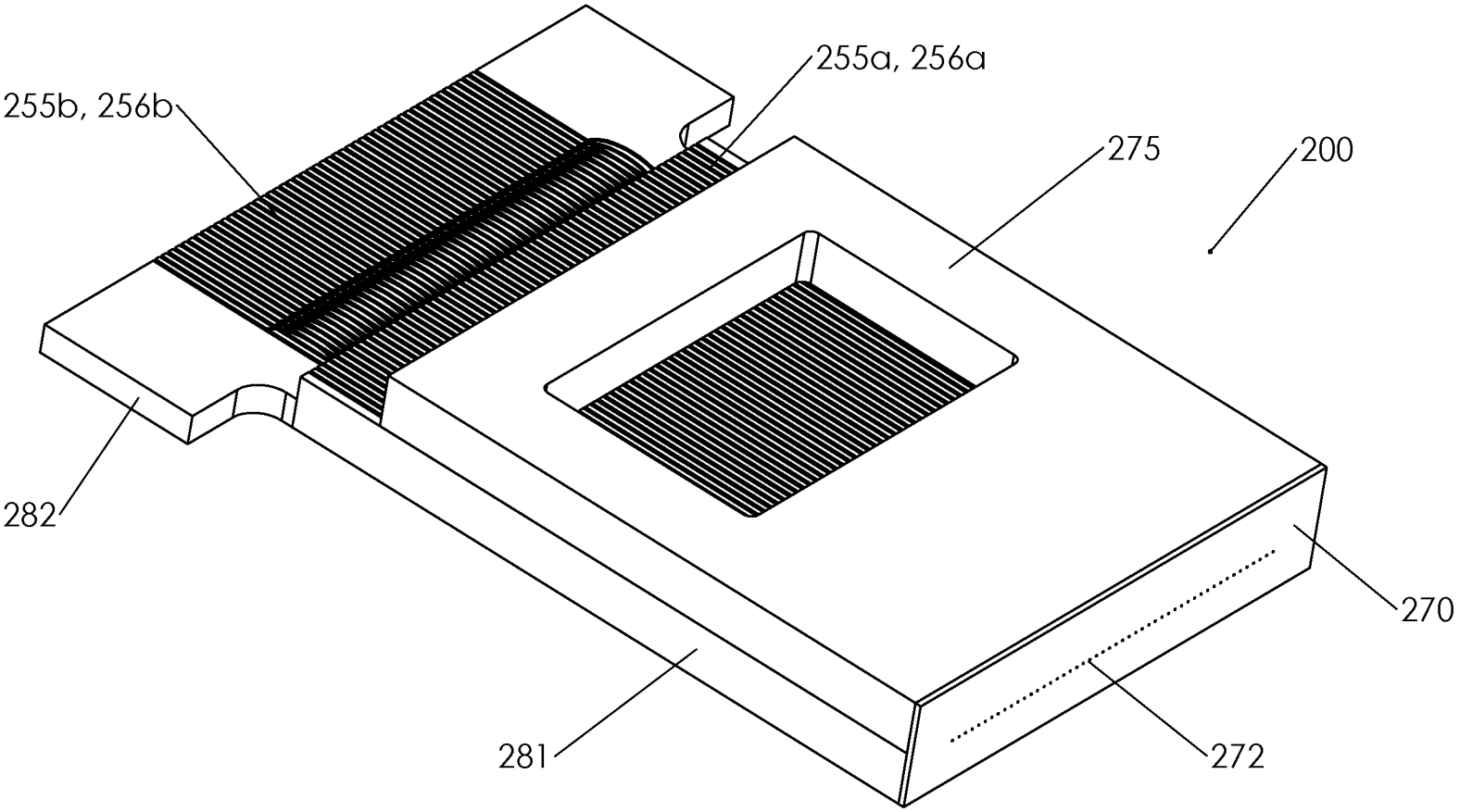
FIG. 3B is a view of the actuator component of FIG. 3A following assembly.
Figure 4:
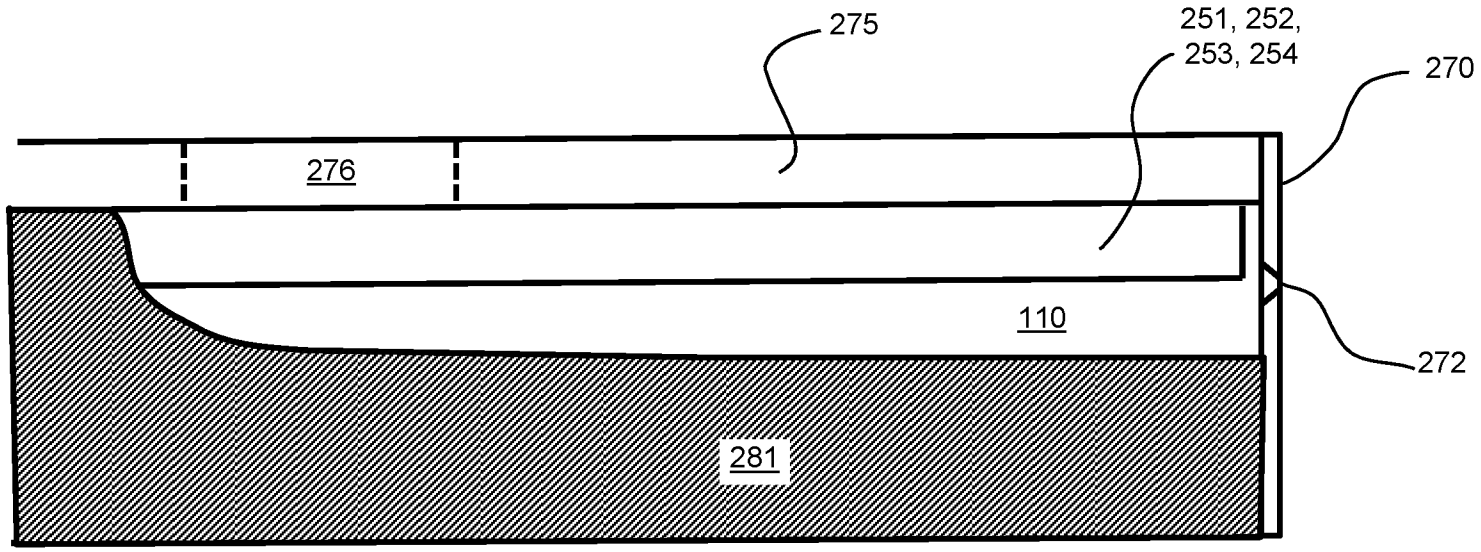
FIG. 4 is a plan view of a cross-section taken along the length of one of the fluid chambers of the actuator component of FIGS. 3A and 3B.

Attention is accordingly directed to FIGS. 3 to 5, which illustrate an actuator component 200 for a droplet deposition head according to a further example embodiment, where each nozzle 272 is provided at the longitudinal end of a firing chamber 210.

FIG. 3A shows an exploded view in perspective of the actuator component 200, which, as in the example embodiment of FIGS. 1A and 1B, includes a multiplicity of fluid chambers 210 arranged side-by-side in an array. As may be seen from the drawing, the actuator component 200 includes a base 281 of piezoelectric material (such as lead zirconate titanate (PZT), however any suitable piezoelectric material may be used) mounted on a circuit board 282 of which only a section showing conductive traces 255*a*, 256*b* is illustrated.

A cover plate 275, which is bonded during assembly to the base 281, is shown above its assembled location. A nozzle plate 270 is also shown adjacent the base 281, spaced apart from its assembled position.

A multiplicity of parallel grooves is formed in the base 218. The grooves comprise a forward part in which they are comparatively deep to provide elongate fluid chambers 210 separated by opposing walls 230, 240, these walls being formed of the piezoelectric material of the base 218. The grooves in the rearward part are comparatively shallow to provide locations for connection traces.

After forming the grooves, metallized plating is deposited in the forward part providing electrodes 251-254 on the chamber-facing surfaces of the walls in the forward part of each groove. In the rearward parts of the grooves, the metallized plating provides conductive traces 255*a*, 256*a* that are connected to actuation electrodes 251-252 for the fluid chambers 110.

The base 281 is mounted as shown in FIG. 3A on the circuit board 282 and bonded wire connections are made connecting the conductive traces 255*a*, 256*a* on the base 281 to the conductive traces 255*b*, 256*b* on the circuit board 282. Similarly to the traces 155, 156 of the actuator component of FIGS. 1 and 2, these traces 255, 256 may electrically connect the actuation electrodes 151, 152 to ground or to voltage signals.

The actuator component 200 of FIG. 3A is illustrated after assembly in FIG. 3B. In the assembled actuator component 200, the cover 275 is secured by bonding to the tops of the walls 130, 140 thereby forming a multiplicity of closed, elongate fluid chambers 20 having access at one end to the window 276 in the cover plate 275 which provides a manifold for the supply of replenishment fluid. The nozzle plate 270 is attached, for example by bonding, at the other end of the fluid chambers 210. The nozzles 272 maybe formed at locations in the nozzle plate 270 corresponding with each fluid chamber, for instance by UV excimer laser ablation. As will be apparent from FIG. 3B, the nozzles 272 are thus each provided at a longitudinal end of the corresponding one of the fluid chambers 210.

During use of the droplet deposition head of which the actuator component 200 of FIGS. 3 and 4 forms a part, fluid is drawn into the fluid chambers 210 through the window 276 in the cover plate 275. The droplet deposition head may accordingly further include one or more manifold components that can be connected to a fluid supply system.

FIG. 4 is a plan view of a cross-section taken along the length of one of the fluid chambers 210 of the actuator component 200 of FIGS. 3 to 5. As may be seen in the drawing, the electrodes 251-254 extend over only a portion of the height of the walls 230, 240. More particularly, they extend from the top of the walls (nearmost the cover plate 275) to approximately one half of the way down the channel height. As may also be seen, the window 276 in the cover plate 275 is located to one longitudinal side of the fluid chambers 210 towards one longitudinal end thereof; at the other longitudinal end, there is provided the nozzle plate 270, which extends generally in a plane whose normal direction is the chamber length direction (which is left-to-right in FIG. 4).

Figure 5A:
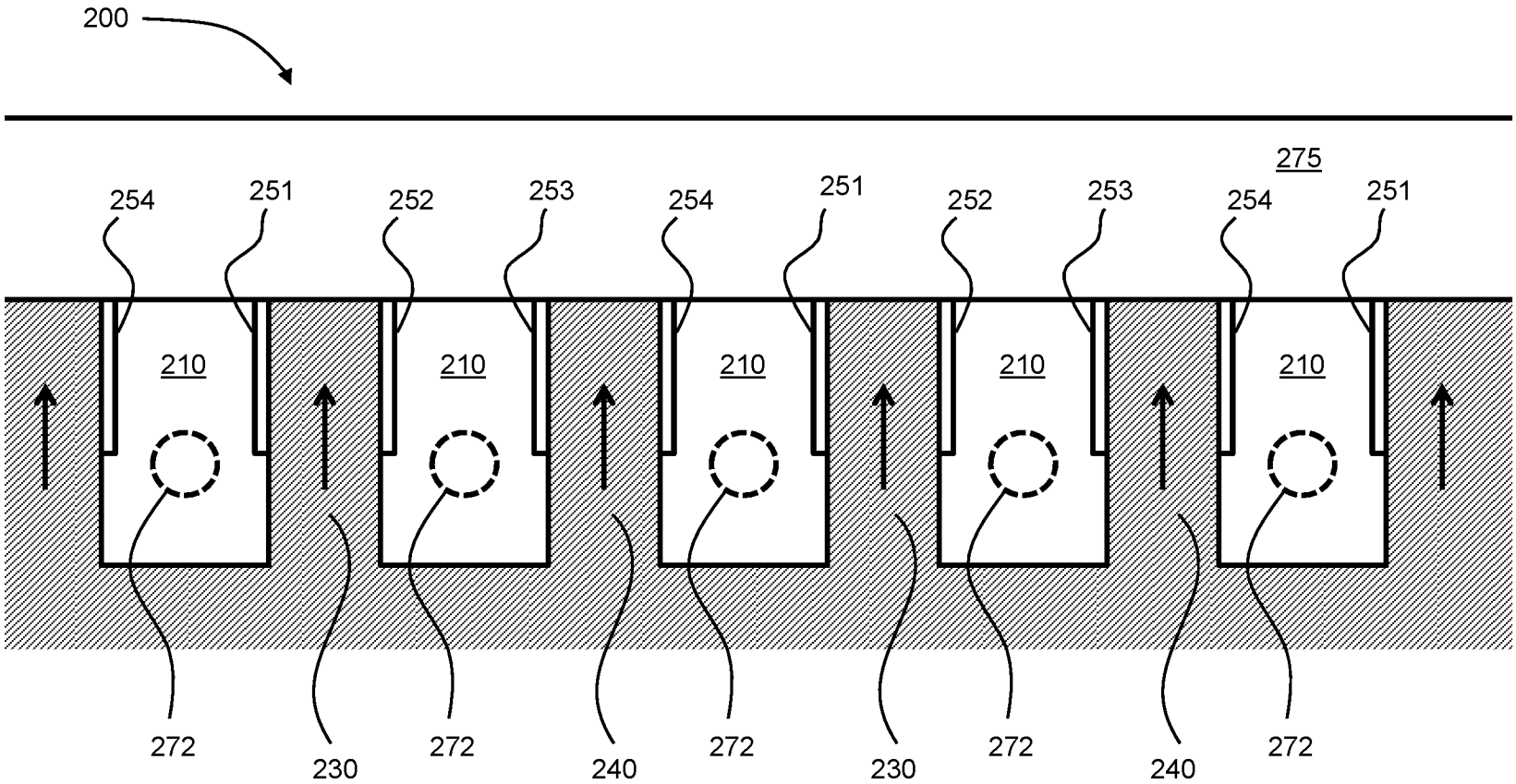
FIG. 5A is a plan view of a cross-section taken perpendicular to the lengths of the fluid chambers of the actuator component of FIGS. 3A, 3B and 4.
Figure 5B:
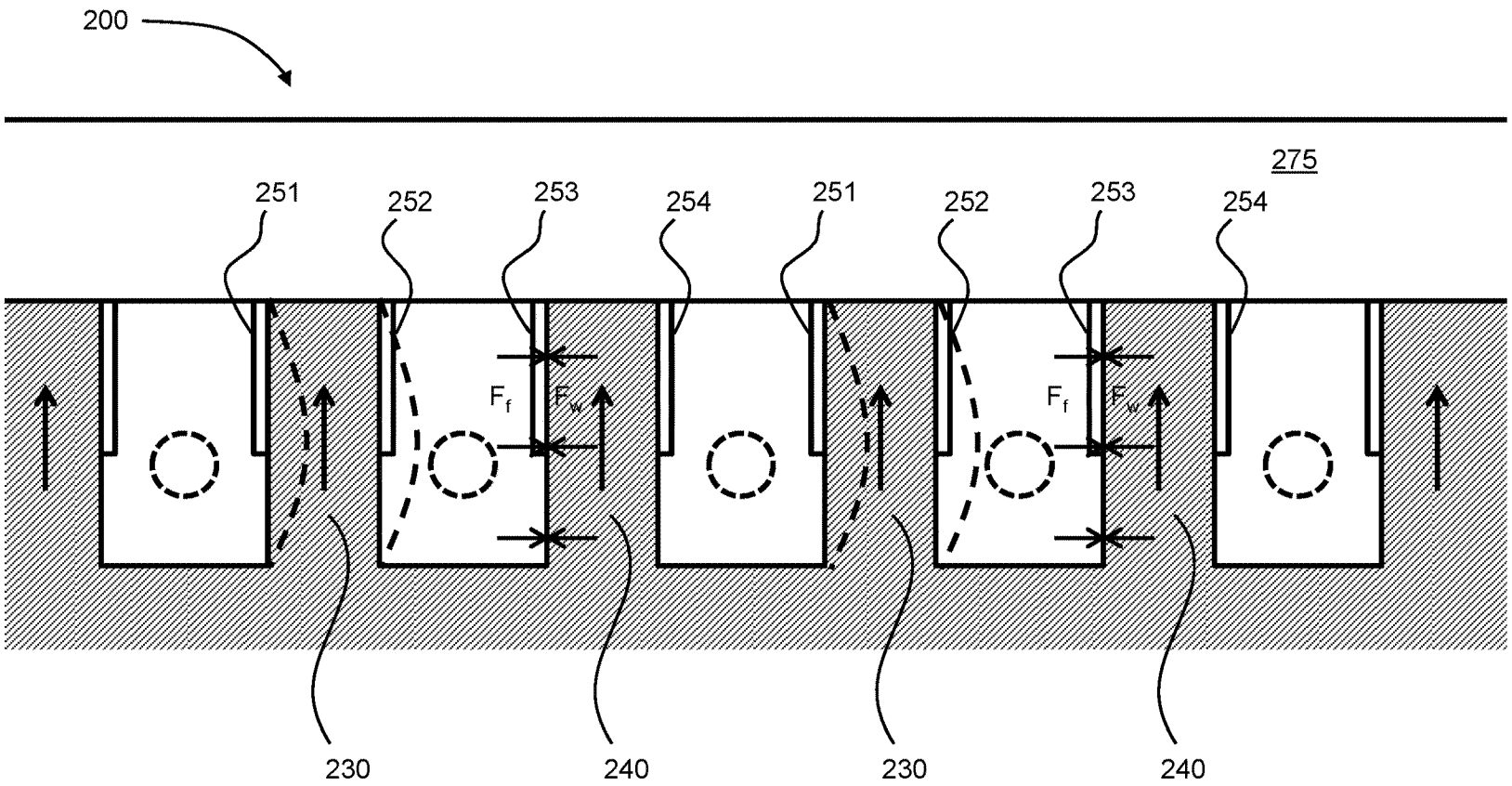
FIG. 5B is a further plan view of a cross-section taken perpendicular to the lengths of the fluid chambers of the actuator component of FIGS. 3A, 3B, 4 and 5A that illustrates the application of drive waveforms to actuable walls of the actuator component.

FIGS. 5A and 5B are plan views in the chamber length direction of a cross-section through the actuator component 200 of FIGS. 3 to 5. FIG. 5A shows, in a similar manner to FIG. 1A, the relative disposition of the fluid chambers 210 and chamber walls 230, 240.

As with the actuator component 100 of FIG. 1A, each of the fluid chambers 210 is a firing chamber and is thus provided with a nozzle 272 for droplet ejection. Also as with the actuator component 100 of FIG. 1A, the actuator component 200 of FIGS. 3 to 5 includes actuable walls 230, which may be actuated to cause droplet ejection, and non-actuable walls 240, which cannot be actuated. As may be seen from FIG. 5A, the actuable walls 230 are provided alternately with the non-actuable walls 240 in the array direction.

Each actuable wall 230 is provided with a first electrode 251 and a second electrode 252. The first electrode 251 is disposed on a first side surface of the actuable wall 230, which faces towards one of the two fluid chambers 210 that the actuable wall 230 in question separates, whereas the second electrode 252 is disposed on a second side surface of the actuable wall 230, which is opposite the first side surface and faces towards the other of the two fluid chambers 210 that the actuable wall 230 in question separates.

Similarly to the actuation electrodes 151, 152 discussed above with reference to FIG. 1B, the actuation electrodes 251, 252 shown in FIGS. 5A and 5B are configured to apply a drive waveform to the actuable walls 230, which are thereby deformed. As a result, the actuator component 200 is able to increase the pressure of the fluid within selected firing chambers 210, hence causing droplet ejection from these selected chambers. This selection may vary in dependence upon the input data received by the actuator component 200. Each of the actuable walls 230 therefore acts as a piezoelectric actuating element.

In contrast to the actuator component 100 of FIG. 1A, the piezoelectric material of each of the chamber walls 230, 240 is poled generally only in one direction, which is perpendicular to the array direction (left-to-right in FIG. 5A) and to the chamber length direction (into the page in FIG. 5A).

As noted above, the first 251 and second 252 actuation electrodes are configured to apply a drive waveform to the actuable wall 230. FIG. 5B, which is a further cross-sectional view of the actuator component 200 of FIG. 5A, illustrates the effect of the application of this drive waveform to an actuable wall 230.

As may be seen from the dashed-lines in the drawing, the drive waveform causes the actuable wall 230 to deform in shear mode towards one of the two fluid chambers 210 that it separates, with this deformation causing an increase in the pressure of the fluid within that one of the two fluid chambers 210. The deformation also causes a corresponding reduction in the pressure of the other one of the two fluid chambers 210. It will be appreciated that a drive waveform of opposite polarity will cause the actuable wall 230 to deform in the opposite direction, thus having substantially the opposite effect on the pressure of the fluid within the two chambers 210 separated by the actuable wall 230.

Hence, or otherwise, droplets may be ejected alternately by each one of the pair of firing chambers 210 separated by the actuable wall 230. With a suitable drive waveform this may lead, for example, to one of the pair of firing chambers 210 ejecting N droplets, and the other of the pair of firing chambers 210 ejecting M droplets, where N differs from M by at most 1. More particularly, the drive waveform may cause the actuable wall 230 of the pair of firing chambers 210 to be actuated such that an equal number of droplets is ejected by each of the firing chambers 210 (i.e. N is equal to M).

Hence, or otherwise, the firing chambers 210 may thus be considered as being actuated in pairs. The input data for the droplet deposition head of which the actuator component 200 forms a part may be processed accordingly, for example with a suitable screening algorithm.

As with the actuator component 100 of FIG. 1A, the actuable wall 230 deforms in chevron configuration in response to the drive waveform. This is as a result of the poling direction of the piezoelectric material in each actuable wall 230 and the fact that the actuation electrodes 251, 252 extend over only a portion of the height of the actuable wall 230.

More particularly, the actuation electrodes 251, 252 apply an electrical field that is generally oriented in the array direction (left-to-right in FIG. 5B) and that is generally strongest over the portion of the height of the actuable wall that the actuation electrodes 251, 252 extend over (the top portion in FIG. 5B). This causes that portion of the actuable wall 230 to deform in shear mode, owing to the reverse piezoelectric effect; however, this portion of the actuable wall also applies a mechanical force to the portion of the actuable wall connected to it (the bottom portion in FIG. 5B), "pulling" the connected portion with it. As may be seen from FIG. 5B, this results in the actuable wall 230 deforming in chevron configuration, as is shown in dashed-line in FIG. 5B.

It should of course be appreciated that deformation in chevron configuration may be achieved with different arrangements of the actuable wall 230 and the first 251 and second 252 actuation electrodes. For example, each of the actuable walls might include a first portion and a second portion, with the piezoelectric material of the first portion being poled in an opposite direction to the piezoelectric portion of the second portion. The poling directions of each of the first portion and the second portion may be perpendicular to the array direction and to the chamber length direction. The first and second portions may be separated by a plane defined by the array direction and the chamber length direction.

As may also be seen from FIGS. 5A and 5B, each non-actuable wall 240 is similarly provided with a first electrode 253 and a second electrode 254. The first 253 and second 254 electrodes of the non-actuable walls 240 are electrically isolated and may thus be characterized as isolated electrodes.

As may be seen from FIGS. 5A and 5B, the first isolated electrode 253 is disposed on a first side surface of the non-actuable wall 240, which faces towards one of the two fluid chambers 210 that the non-actuable wall 240 in question separates, whereas the second isolated electrode 254 is disposed on a second side surface of the non-actuable wall 240, which is opposite the first side surface and faces towards the other of the two fluid chambers 210 that the non-actuable wall 240 in question separates.

The first 253 and second 254 isolated electrodes may more particularly be isolated from each other. In addition, they may be electrically isolated from the traces 255*a*, 256*a*, 255*b*, 256*b* that connect the actuation electrodes 251, 252 to voltage signals, or to ground.

When the pressure of the fluid within a chamber 210 is increased (or decreased), whether as a result of the action of the actuable walls 230, or otherwise, the fluid will generally apply a corresponding fluid force ($F_f$) to the walls of the chamber. When such a fluid force is applied to a non-actuable wall 240, as a result of the electrical isolation of the isolated electrodes 253, 254, a charge is induced in each of the isolated electrodes 253, 254. These induced charges, because they cannot leave the isolated electrodes 253, 254, result in an electric field being applied to the non-actuable wall 240, which in turn causes the piezoelectric material of the non-actuable wall 240 to apply a force ($F_w$) in opposition to the fluid force.

It may therefore be appreciated that, in contrast, to the actuable walls 230, the non-actuable walls 240 utilize the direct piezoelectric effect.

In the situation illustrated in FIG. 5B, the force ($F_w$) produced by the non-actuable walls 240 in opposition to the fluid force ($F_f$) may result in less pressure being transmitted from the fluid chamber on one side of the non-actuable wall 240 to the fluid chamber on the other side of the non-actuable wall 240.

The non-actuable walls 240 may be "stiffer", as a result of the provision of the isolated electrodes 253, 254. As a result, the non-actuable walls 240 may not transmit significant forces to the surrounding portions of the actuator component 200, such as the nozzle plate 270 or the opposing base portion of the actuator component.

Hence, or otherwise, the droplet deposition head of which the actuator component 200 forms a part may experience less interference or "crosstalk" between neighboring or nearby firing chambers 210 when they are actuated at the same time (or substantially the same time) to eject droplets.

The non-actuable walls 240 may be made stiffer still by forming them with a thickness in the array direction that is greater than that of the actuable walls 230 and/or by forming the isolated electrodes 253, 254 with greater thickness than the actuation electrodes 251, 252.

As noted above, in the actuator components 100, 200 shown in FIGS. 1 to 5, each of the fluid chambers 110, 210 may be characterized as "firing chambers" and is provided is provided with a nozzle 172, 272, from which fluid contained within the chamber 110, 210 may be ejected.

However, it will be appreciated that it is not essential that all of the chambers 110, 210 are arranged in such a manner.

Figure 6:
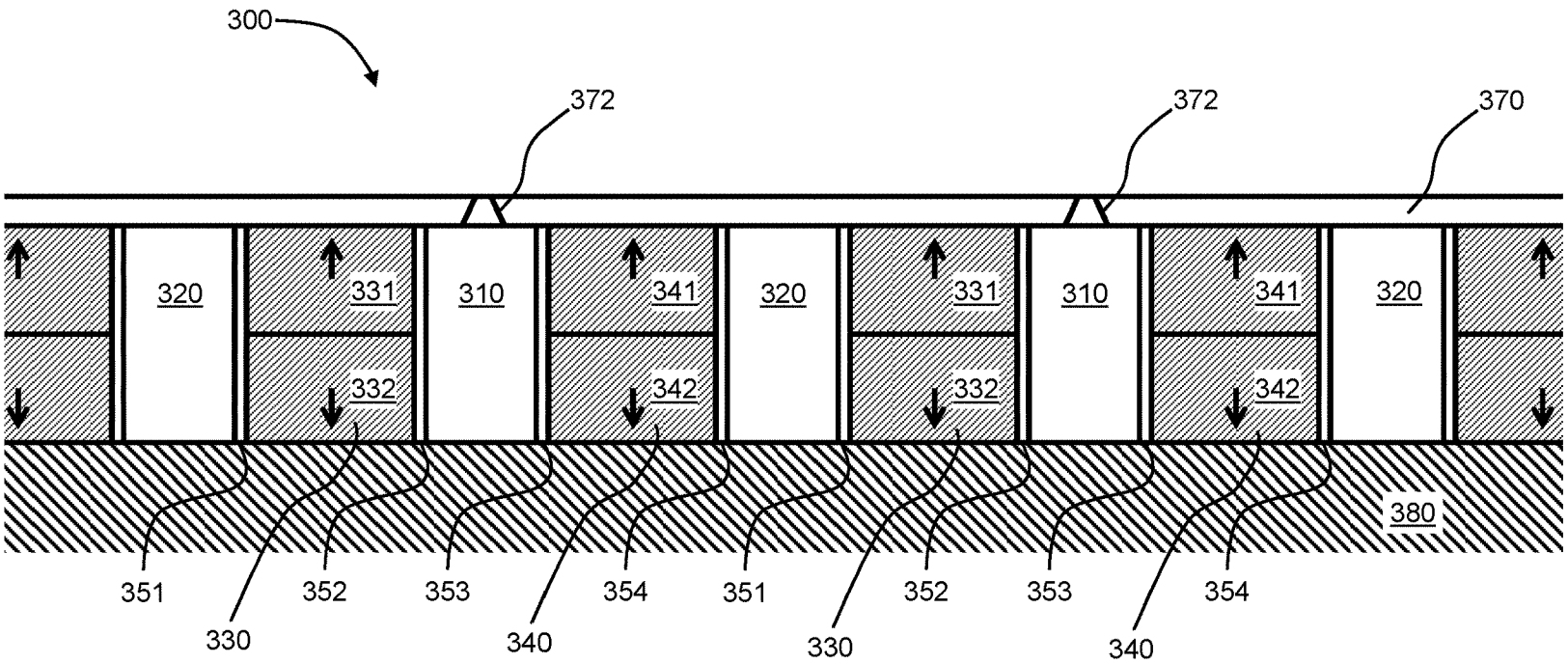
FIG. 6 is a plan view of a cross-section taken perpendicular to the lengths of the fluid chambers of an actuator component for a droplet deposition head according to a further example embodiment that provides non-firing chambers, which are configured such that they are unable to eject droplets.

FIG. 6 illustrates an actuator component 300 for a droplet deposition head according to a further example embodiment, which is generally similar in construction to the actuator component of FIGS. 1A and 1B, but which includes both firing chambers 310, from which fluid may be ejected, and non-firing chambers 320, which are configured such that they are unable to eject droplets. As may be seen from FIG. 6, while each of the firing chambers 310 is provided with a nozzle 372 for droplet ejection, the non-firing chambers 320 are not provided with nozzles.

Similarly to the actuator component 100 of FIGS. 1A and 1B, actuable walls 330 are provided alternately with non-actuable 340 walls in the array direction (from left-to-right in FIG. 6). The actuable walls 330 and non-actuable walls 340 comprise piezoelectric material, such as lead zirconate titanate (PZT), however any suitable piezoelectric material may be used.

Each actuable wall 330 is provided with a first 351 and a second 352 actuation electrode. As with the actuation electrodes 151, 152, 251, 252 discussed above with reference to FIGS. 1 to 5, the actuation electrodes 351, 352 shown in FIG. 6 are configured to apply a drive waveform to the actuable walls 330, which are thereby deformed. As a result, the actuator component 300 is able to increase the pressure of the fluid within selected firing chambers 310, hence causing droplet ejection from these selected chambers. This selection may vary in dependence upon the input data received by the droplet deposition head of which the actuator component 300 forms a part. Each of the actuable walls 330 therefore acts as a piezoelectric actuating element.

As may also be seen from FIG. 6, each non-actuable wall 340 is provided with a first 353 and a second 354 isolated electrode. The first 353 and second 354 isolated electrodes may more specifically be isolated from each other. In addition, they may be electrically isolated from traces (not shown) that connect the actuation electrodes 351, 352 to voltage signals, or to ground.

When the pressure of the fluid within a firing chamber 310 is increased (or decreased), whether as a result of the action of the actuable walls 330, or otherwise, the fluid will generally apply a corresponding fluid force ($F_f$) to the walls of that firing chamber 310. When such a fluid force is applied to a non-actuable wall 340, as a result of the electrical isolation of the isolated electrodes 353, 354, a charge is induced in each of the isolated electrodes 353, 354. These induced charges, because they cannot leave the isolated electrodes 353, 354, result in an electric field being applied to the non-actuable wall 340, which in turn causes the piezoelectric material of the non-actuable wall 340 to apply a force ($F_w$) in opposition to the fluid force.

The non-actuable walls 340 may thus be "stiffer", as a result of the provision of the isolated electrodes 353, 354. As a result, the non-actuable walls 340 may not transmit significant forces to the surrounding portions of the actuator component 300, such as the substrate or base, or the nozzle plate 370. This may, for example, mean that there is less interference or "crosstalk" between nearby firing chambers 310 when they are actuated at the same time (or substantially the same time) to eject droplets.

The non-actuable walls 340 may be made stiffer still by forming them with a thickness in the array direction that is greater than that of the actuable walls 330 and/or by forming the isolated electrodes 353, 354 with greater thickness than the actuation electrodes 351, 352.

In addition to, or instead of each of the non-firing chambers lacking a nozzle 372 for droplet ejection, each of the non-firing chambers 320 may be sealed such that the droplet fluid (which will be present in the firing chambers 310) is prevented from entering the non-firing chambers. Thus, the non-firing chambers 320 may optionally be configured such that they are filled only with air during use.

As may also be seen from FIG. 6, the firing chambers 310 are provided alternately with the non-firing chambers 320 in the array direction (from left-to-right in FIG. 6). It should however be understood that any suitable arrangement of the firing 310 and non-firing 320 chambers might be utilized. Thus, the firing 310 and non-firing 320 chambers might be provided in a repeating pattern in the array direction.

It may be noted that, in the specific actuator component 300 shown in FIG. 6, each nozzle 372 is provided in one longitudinal side of the corresponding one of the firing chambers 330, similarly to the actuator component 100 of FIGS. 1A to 1B. However, it should be appreciated that the nozzles 372 could instead be provided at the longitudinal ends of the firing chambers 330, similarly to the actuator component of FIGS. 3 to 5.

It may be further noted that, in the actuator components for droplet deposition heads described with reference to FIGS. 1-6, the actuation electrodes and the isolated electrodes are described as being provided on the chamber facing surfaces of the actuable walls and the non-actuable walls respectively. However, although such an arrangement may be somewhat easier to manufacture (since this may be accomplished by, for instance, the application of a conductive coating to the interior surfaces of the chambers after formation) it should be understood that such an arrangement is not essential. Accordingly, the actuation electrodes and/or the isolated electrodes could be spaced apart in a chamber height direction, which is perpendicular to the array direction and to the chamber length direction. In such cases, the poling direction of the walls may be altered, for instance so as to be parallel to the array direction.

More generally, it should be appreciated that various arrangements of the actuation electrodes with respect to the poling direction(s) of the piezoelectric material within the actuable walls are possible. For instance, the actuation electrodes may be arranged with respect to the poling direction(s) of the piezoelectric material within the actuable walls such that at least a portion the actuable walls deform in direct mode. In one such example, the actuation electrodes may be spaced apart in the array direction (e.g. provided on the chamber-facing surfaces of the actuable wall), with the piezoelectric material of the actuable wall being poled in the array direction, so that the actuable wall deforms in direct mode. In another such example, a portion of the actuable wall may deform in shear mode, whereas a portion may deform in direct mode; for instance, the actuation electrodes may be spaced apart in the array direction, with a portion of the actuable wall poled in the array direction and a portion poled in the height direction (an example of such an arrangement is described in WO2006/005952 with reference to FIG. 9 thereof).

Similarly, it will be appreciated that various arrangements of the isolated electrodes with respect to the poling direction(s) of the piezoelectric material within the non-actuable walls are possible. In particular, the alternative arrangements described for the actuation electrodes and actuable walls might be employed with the isolated electrodes and non-actuable walls.

It may still further be noted that, in the actuator components for droplet deposition heads described with reference to FIGS. 1-6, the actuable walls and non-actuable walls shared a number of similarities, for example in terms of the disposition of the electrodes relative to the poling direction(s) of the piezoelectric material of the wall. However, it should be appreciated that such similarities between the actuable and non-actuable walls (and their electrodes) are not essential. To give but one example, the actuable walls and actuation electrodes could be arranged as in the actuator component 100 of FIGS. 1A and 1B, with the actuable walls including first and second portions that are poled in opposite directions, whereas the non-actuable walls and isolated electrodes could be arranged as in the droplet actuator component 200 of FIGS. 3 to 5, with the isolated electrodes extending over only a portion of the height of the non-actuable walls. The converse arrangement is of course also contemplated.

Still further, it may be noted that in the actuator components for droplet deposition heads described with reference to FIGS. 1-6 the actuable walls 130, 230 are provided alternately with the non-actuable walls 140, 240 in the array direction. However, it should be appreciated that any suitable arrangement of the actuable walls 130, 230 and non-actuable walls 140, 240 in the array direction could be utilized. For example, the actuable walls and non-actuable walls may be provided in a repeating pattern with respect to the array direction, which may simplify manufacture.

In the actuator component 300 described above with reference to FIG. 6, the firing and non-firing chambers are generally aligned in the height direction, which is perpendicular to the array direction and to the chamber length direction. It should, however, be appreciated that this is not essential.

Figure 7A:
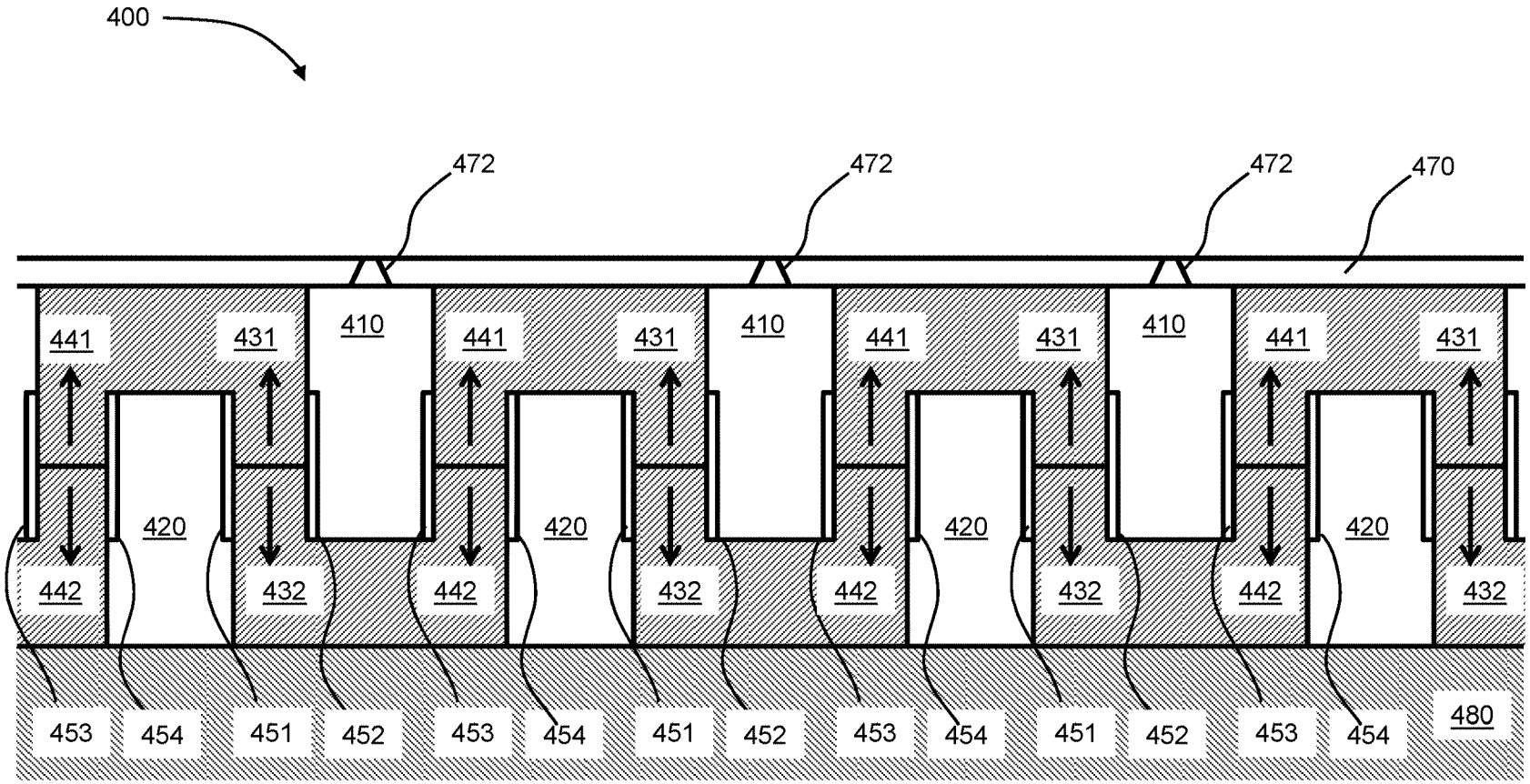
FIG. 7A is a plan view of a cross-section taken perpendicular to the lengths of the fluid chambers of an actuator component for a droplet deposition head according to a still further example embodiment, where non-firing chambers are offset from firing chambers in a height direction.
Figure 7B:
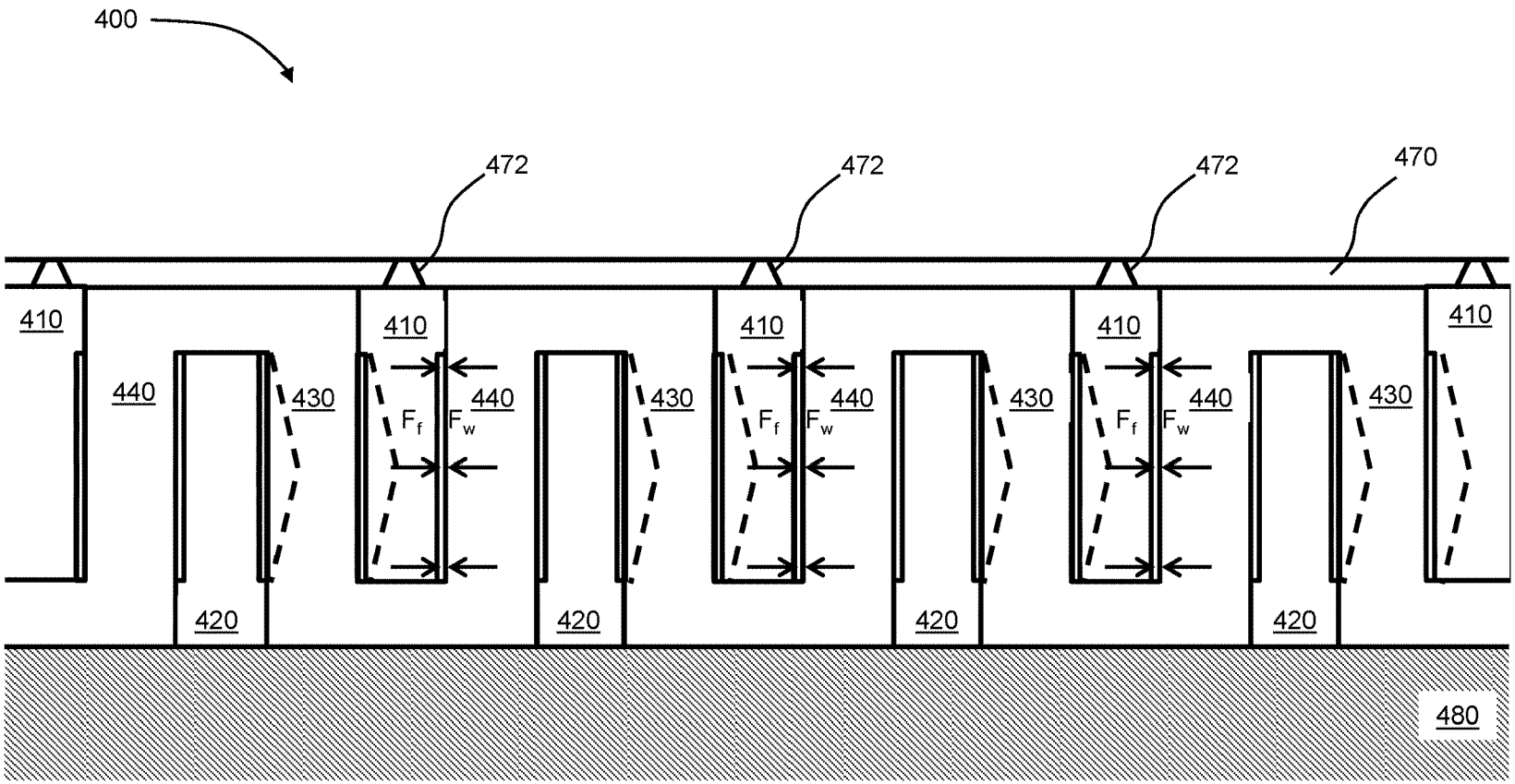
FIG. 7B is a further plan view of a cross-section taken perpendicular to the lengths of the fluid chambers of the actuator component of FIG. 7A that illustrates the application of a drive waveform to actuable walls of the actuator component.

FIGS. 7A and 7B illustrates an actuator component for a droplet deposition head according to a further example embodiment, where non-firing chambers 420 are offset from firing chambers 410 in a height direction, which is perpendicular to the array direction and to the chamber length direction.

As may be seen from FIG. 7A, which is a plan view of a cross section through the actuator component 400, this may be accomplished by forming a multiplicity of non-firing chambers 420 side-by-side in one planar surface of a body formed of piezoelectric material; and by forming a multiplicity of firing chambers 410 side-by-side in the opposing planar surface of the body formed of piezoelectric material. The firing 410 and non-firing 420 chambers together provide an array of fluid chambers that extends in an array direction (left-to-right in FIGS. 7A and 7B). The lengths of the firing chambers 410 may be parallel to one another and to the lengths of the non-firing chambers 420. Additionally, or instead, the lengths of the firing chambers 410 and the lengths of the non-firing chambers 420 may be perpendicular to the array direction.

In the specific arrangement shown in FIG. 7A, firing chambers are closed along (at least a portion of) their lengths by a nozzle plate 470, which provides a nozzle 472 for each of the firing chambers 410. In this way, each nozzle 472 is provided in one longitudinal side of the corresponding one of the firing chambers 430 (of course other approaches may achieve this as well: a separate nozzle plate 470 component is not required).

It should be appreciated that an interposer layer could be provided between the nozzle plate 470 and the surface of the body of piezoelectric material in which the firing chambers 410 are formed. This interposer layer may, for example, provide a respective aperture for each of the nozzles 472 of the nozzle plate. Such apertures will typically be wider than the nozzles 472, so that the fluid contacts only the nozzles 472 during droplet ejection.

The non-firing chambers are closed along (at least a portion of) their lengths by a substrate 480. This substrate 480 may be formed of a material that is thermally matched to the piezoelectric material of the body in which the firing 410 and non-firing 420 chambers are formed, such as a ceramic material (e.g. alumina).

As may be seen from FIG. 7A, while each of the firing chambers 410 is provided with a nozzle 472 for droplet ejection, the non-firing chambers 420 are not provided with nozzles.

As may also be seen from FIG. 7A, the firing chambers 410 are provided alternately with the non-firing chambers 420 in the array direction. The non-firing chambers 420 overlap with the firing chambers 410 in a height direction, such that a wall formed of piezoelectric material separates each firing chamber 410 from an adjacent non-firing chamber 420.

As is also illustrated in FIG. 7A, each of these walls formed of piezoelectric material 430, 440 includes a first portion 431, 441 and a second portion 432, 442, with the piezoelectric material of the first portion 431, 441 being poled in an opposite direction to the piezoelectric portion of the second portion 432, 442. As may also be seen, the poling direction of each of the first portion 431, 441 and the second portion 432, 442 is perpendicular to the array direction and to the chamber length direction. The first 431, 441 and second 432, 442 portions are separated by a plane defined generally by the array direction and the chamber length direction.

In the specific arrangement illustrated in FIG. 7A, the separating plane is the same for all of the walls (it being noted that this is not essential, though it may simplify manufacture). More particularly, this separating plane is located approximately at a half-way point of the height of the body of piezoelectric material in which the firing 410 and non-firing 420 chambers are formed.

Certain of these walls formed of piezoelectric material are actuable walls 430, whereas others are non-actuable walls 440. More particularly, the actuable walls 430 are provided alternately with the non-actuable 440 walls in the array direction (left-to-right in FIGS. 7A and 7B). Each firing chamber 410 is provided with one actuable wall 430 and one non-actuable wall 440; similarly, each non-firing chamber 420 is provided with one actuable wall 430 and one non-actuable wall 440.

As may be seen from FIGS. 7A and 7B, each actuable wall 430 is provided with a first actuation electrode 451 and a second actuation electrode 452. The first actuation electrode 451 is disposed on a first side surface of the actuable wall 430, which faces towards one of the two fluid chambers 410, 420 that the actuable wall 430 in question separates, whereas the second actuation electrode 452 is disposed on a second side surface of the actuable wall 430, which is opposite the first side surface and faces towards the other of the two fluid chambers 410, 420 that the actuable wall 430 in question separates.

Similarly to the actuation electrodes 151, 152, 251, 252, 351, 352 discussed above with reference to FIGS. 1-6, the actuation electrodes 451, 452 shown in FIGS. 7A and 7B are configured to apply a drive waveform to the actuable walls 430, which are thereby deformed. As a result, the actuator component 400 is able to increase the pressure of the fluid within selected firing chambers 410, hence causing droplet ejection from these selected chambers. This selection may vary in dependence upon the input data received by the droplet deposition head of which the actuator component forms a part 400. Each of the actuable walls 430 therefore acts as a piezoelectric actuating element.

As a result of the arrangement of the first 431 and second 432 portions and their different poling directions, when a drive waveform is applied to the actuable wall 430 by the first 451 and second 452 actuation electrodes, the actuable wall 430 deforms in a chevron configuration, whereby the first 431 and second 432 portions deform in shear mode in opposite senses, as is shown in dashed-line in FIG. 7B.

As may be seen from FIG. 7A, each non-actuable wall 440 is provided with a first 453 and a second 454 isolated electrode. The first 453 and second 454 isolated electrodes may more specifically be isolated from each other. In addition, they may be electrically isolated from traces (not shown) that connect the actuation electrodes 451, 452 to voltage signals, or to ground.

When the pressure of the fluid within a firing chamber 410 is increased (or decreased), whether as a result of the action of the actuable walls 430, or otherwise, the fluid will generally apply a corresponding fluid force ($F_f$) to the walls of that firing chamber 410. When such a fluid force is applied to a non-actuable wall 440, as a result of the electrical isolation of the isolated electrodes 453, 454, a charge is induced in each of the isolated electrodes 453, 454. These induced charges, because they cannot leave the isolated electrodes 453, 454, result in an electric field being applied to the non-actuable wall 440, which in turn causes the piezoelectric material of the non-actuable wall 440 to apply a force ($F_w$) in opposition to the fluid force.

The non-actuable walls 440 may thus be "stiffer", as a result of the provision of the isolated electrodes 453, 454. As a result, the non-actuable walls 440 may not transmit significant forces to the surrounding portions of the actuator component 400, such as the substrate 480, or the nozzle plate 470. This may, for example, mean that there is less interference or "crosstalk" between nearby firing chambers 410 when they are actuated at the same time (or substantially the same time) to eject droplets.

The non-actuable walls 440 may be made stiffer still by forming them with a thickness in the array direction that is greater than that of the actuable walls 430 and/or by forming the isolated electrodes 453, 454 with greater thickness than the actuation electrodes 451, 452.

Figure 8A:
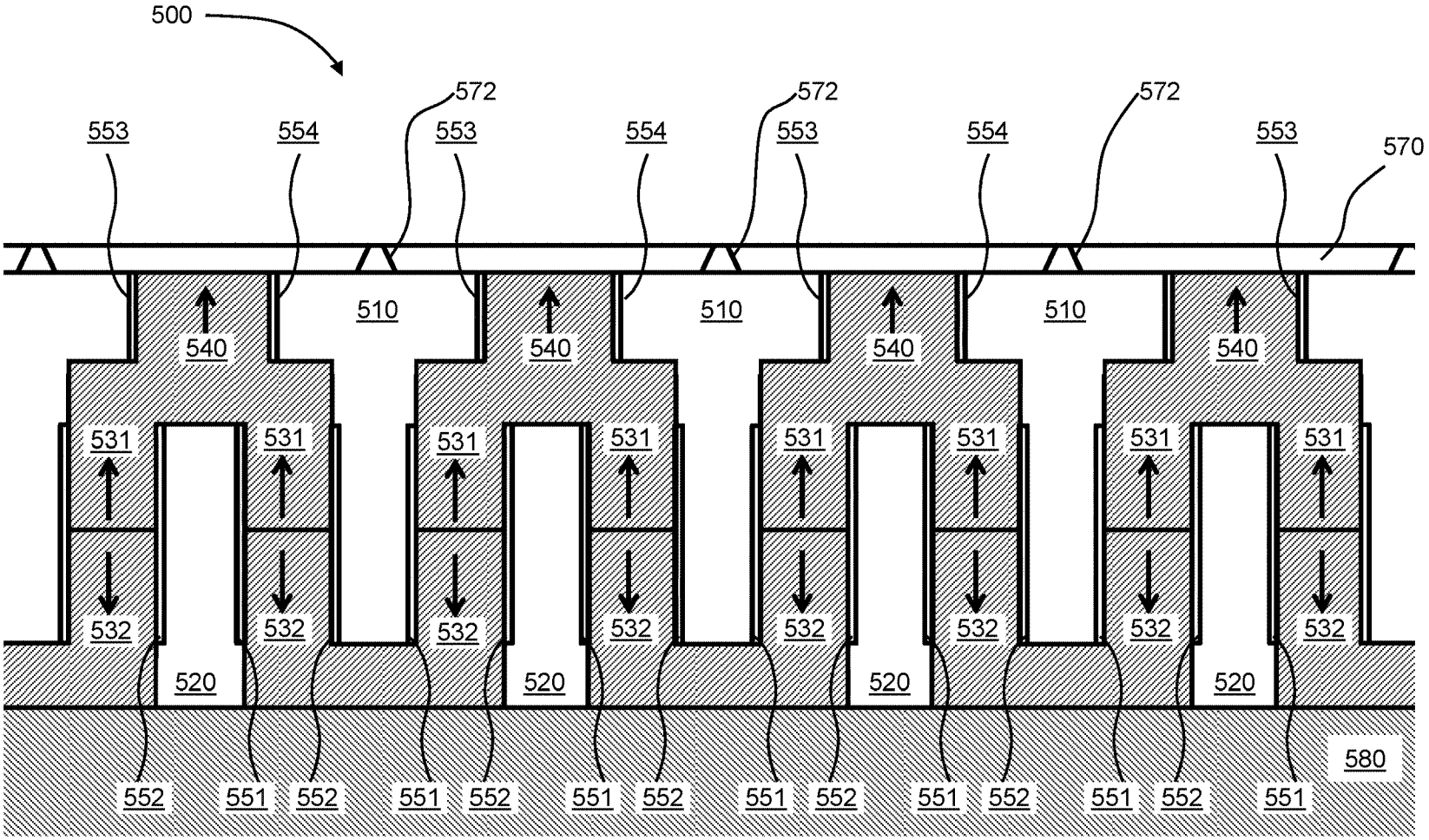
FIG. 8A is a plan view of a cross-section taken perpendicular to the lengths of the fluid chambers of an actuator component for a droplet deposition head according to a further example embodiment, which is of generally similar construction to that of FIGS. 7A and 7B, but in which each firing chamber is provided with two actuable walls.
Figure 8B:
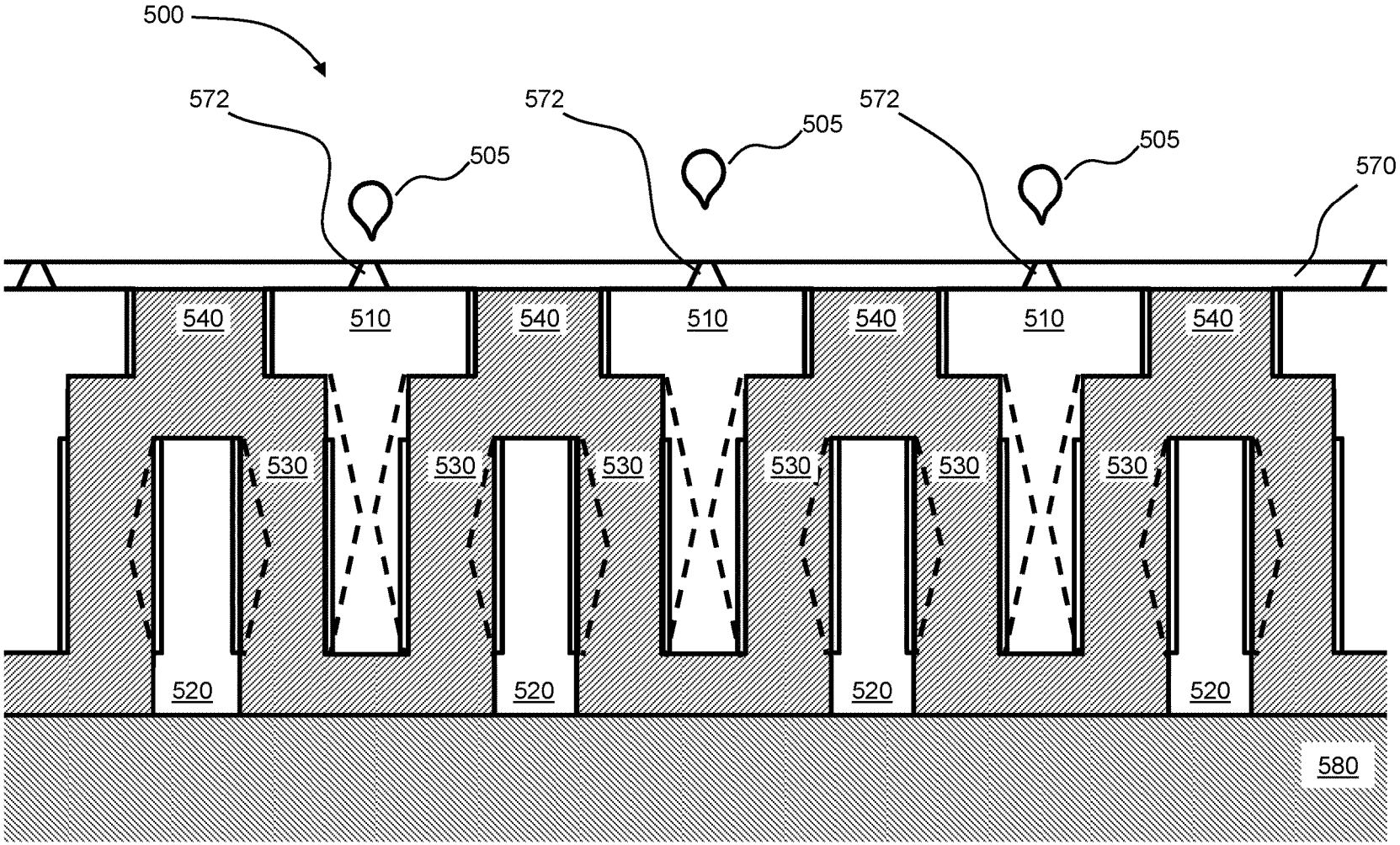
FIG. 8B is a further plan view of a cross-section taken perpendicular to the lengths of the fluid chambers of the actuator component of FIG. 8B that illustrates the application of a drive waveform to actuable walls of the actuator component.

As noted above, in the actuator component 400 of FIGS. 7A and 7B, each firing chamber 410 is provided with one actuable wall 430 and one non-actuable wall 440 (as is each non-firing chamber 420). FIGS. 8A and 8B illustrate an actuator component 500 for a droplet deposition head according to a further example embodiment that is of generally similar construction to that of FIGS. 7A and 7B, but in which each firing chamber 510 is provided with two actuable walls 530.

As with the actuator component 400 of FIGS. 7A and 7B, the non-firing chambers 520 of the actuator component 500 of FIGS. 8A and 8B are offset from firing chambers 510 in a height direction, which is perpendicular to the array direction and to the chamber length direction. As may be seen from FIG. 8A, the firing chambers 510 are provided alternately with the non-firing chambers 520 in the array direction.

Further, as may be seen from FIG. 8A, each of the firing chambers 510 is wider, in the array direction, in a first portion of its height and is narrower, in the array direction, in a second portion of its height (which may be adjacent the first portion). Thus, the firing chamber's width, in the array direction, may be described as tapering with respect to its height. In the specific example shown in FIGS. 8A and 8B, each firing chamber 510 is generally "T"-shaped.

As may also be seen, each non-firing chamber 520 overlaps with a corresponding firing chamber 510 over the second portion of its height. Hence (or otherwise), a wall formed of piezoelectric material separates each firing chamber 510 from an adjacent non-firing chamber 520.

More specifically, this wall is an actuable wall 530 and is therefore provided with a first actuation electrode 551 and a second actuation electrode 552. The first actuation electrode 551 is disposed on a first side surface of the actuable wall 530, which faces towards one of the two fluid chambers 510, 520 that the actuable wall 530 in question separates, whereas the second actuation electrode 552 is disposed on a second side surface of the actuable wall 530, which is opposite the first side surface and faces towards the other of the two fluid chambers 510, 520 that the actuable wall 530 in question separates.

Over the first portion of its height, by contrast, a firing chamber 510 may only overlap with other firing chambers 510. Hence (or otherwise), a wall formed of piezoelectric material separates each firing chamber 510 from an adjacent firing chamber 510. More specifically, this wall is a non-actuable wall 540 and is therefore provided with a first 553 and a second 554 isolated electrode. As may be seen from FIG. 8A, the first isolated electrode 553 is disposed on a first side surface of the non-actuable wall 530, which faces towards one of the two firing chambers 510 that the non-actuable wall 540 in question separates, whereas the second isolated electrode 554 is disposed on a second side surface of the non-actuable wall 540, which is opposite the first side surface and faces towards the other of the two firing chambers 510 that the non-actuable wall 540 in question separates.

Returning now to the actuable walls 530, as may be seen from FIG. 8A, each actuable wall 530 includes a first portion 531 and a second portion 532, with the piezoelectric material of the first portion 531 being poled in an opposite direction to the piezoelectric portion of the second portion 532. As may also be seen, the poling direction of each of the first portion 531 and the second portion 532 is perpendicular to the array direction and to the chamber length direction. The first 531 and second 532 portions are separated by a plane defined generally by the array direction and the chamber length direction. In the specific arrangement illustrated in FIG. 8A, the separating plane is the same for all of the actuable walls 530 (it being noted that this is not essential, though it may simplify manufacture).

Similarly to the actuation electrodes 151, 152, 251, 252, 351, 352, 451, 452 discussed above with reference to FIGS. 1-6, the actuation electrodes 551, 552 shown in FIGS. 8A and 8B are configured to apply a drive waveform to the actuable walls 530, which are thereby deformed. As may be seen from FIG. 8B, the two actuable walls 530 provided for each firing chamber 510 may deform simultaneously (or substantially simultaneously). As compared with the deformation of only a single equivalent actuable wall, this may enable a lower voltage to be used to achieve the same increase in pressure within the firing chamber 510, or may enable a higher pressure to be achieved within the firing chamber 510 using substantially the same voltage.

The actuator component 500 is thus able to increase the pressure of the fluid within selected firing chambers 510, hence causing the ejection of droplets 505 from these selected chambers. This selection may vary in dependence upon the input data received by the actuator component 500. Each of the actuable walls 530 therefore acts as a piezoelectric actuating element.

As a result of the arrangement of the first 531 and second 532 portions and their different poling directions, when a drive waveform is applied to the actuable wall 530 by the first 551 and second 552 actuation electrodes, the actuable wall 530 deforms in a chevron configuration, whereby the first 531 and second 532 portions deform in shear mode in opposite senses, as is shown in dashed-line in FIG. 8B.

As noted above, each non-actuable wall 540 is provided with a first 553 and a second 554 isolated electrode. The first 553 and second 554 isolated electrodes may more specifically be isolated from each other. In addition, they may be electrically isolated from traces (not shown) that connect the actuation electrodes 551, 552 to voltage signals, or to ground.

When the pressure of the fluid within a firing chamber 510 is increased (or decreased), whether as a result of the action of the actuable walls 530, or otherwise, the fluid will generally apply a corresponding fluid force to the walls of that firing chamber 510. When such a fluid force is applied to a non-actuable wall 540, as a result of the electrical isolation of the isolated electrodes 553, 554, a charge is induced in each of the isolated electrodes 553, 554. These induced charges, because they cannot leave the isolated electrodes 553, 554, result in an electric field being applied to the non-actuable wall 540, which in turn causes the piezoelectric material of the non-actuable wall 540 to apply a force in opposition to the fluid force.

This may result in less pressure being transmitted from the firing chamber 510 on one side of the non-actuable wall 540 to the firing chamber 510 on the other side of the non-actuable wall 540.

The non-actuable walls 540 may thus be "stiffer", as a result of the provision of the isolated electrodes 553, 554. As a result, the non-actuable walls 540 may not transmit significant forces to the surrounding portions of the actuator component 500, such as the substrate 580, or the nozzle plate 570.

This may, for example, mean that there is less interference or "crosstalk" between nearby firing chambers 510 when they are actuated at the same time (or substantially the same time) to eject droplets 505.

The non-actuable walls 540 may be made stiffer still by forming them with a thickness in the array direction that is greater than that of the actuable walls 530 and/or by forming the isolated electrodes 553, 554 with greater thickness than the actuation electrodes 551, 552.

It should be noted that it is not essential, in the actuator components of FIGS. 7 and 8, that each of the nozzles 472, 572 be provided in one longitudinal side of the corresponding one of the firing chambers 410, 510: the nozzles 472, 572 could instead be provided at the longitudinal ends of the firing chambers 410, 510, similarly to the actuator component of FIGS. 3 to 5 (for instance a cover plate could replace the nozzle plate shown in FIGS. 7A and 7B, with an alternative nozzle plate being arranged so as to bound the longitudinal ends of the firing and non-firing chambers).

It should be noted that, in addition to, or instead of each of the non-firing chambers in the actuator components of FIGS. 7 and 8 lacking a nozzle 472, 572 for droplet ejection, each of the non-firing chambers 420, 520 may be sealed such that the droplet fluid (which will be present in the firing chambers 410) is prevented from entering the non-firing chambers. Thus, the non-firing chambers 420, 520 may optionally be configured such that they are filled only with air during use.

It is considered that non-actuable walls having isolated electrodes, as described above with reference to FIGS. 1-8, may also be employed in thin-film/MEMS type actuator components for droplet deposition heads. An example of such an actuator component employing non-actuable walls is illustrated in FIG. 9, which is a further example embodiment.

Figure 9:
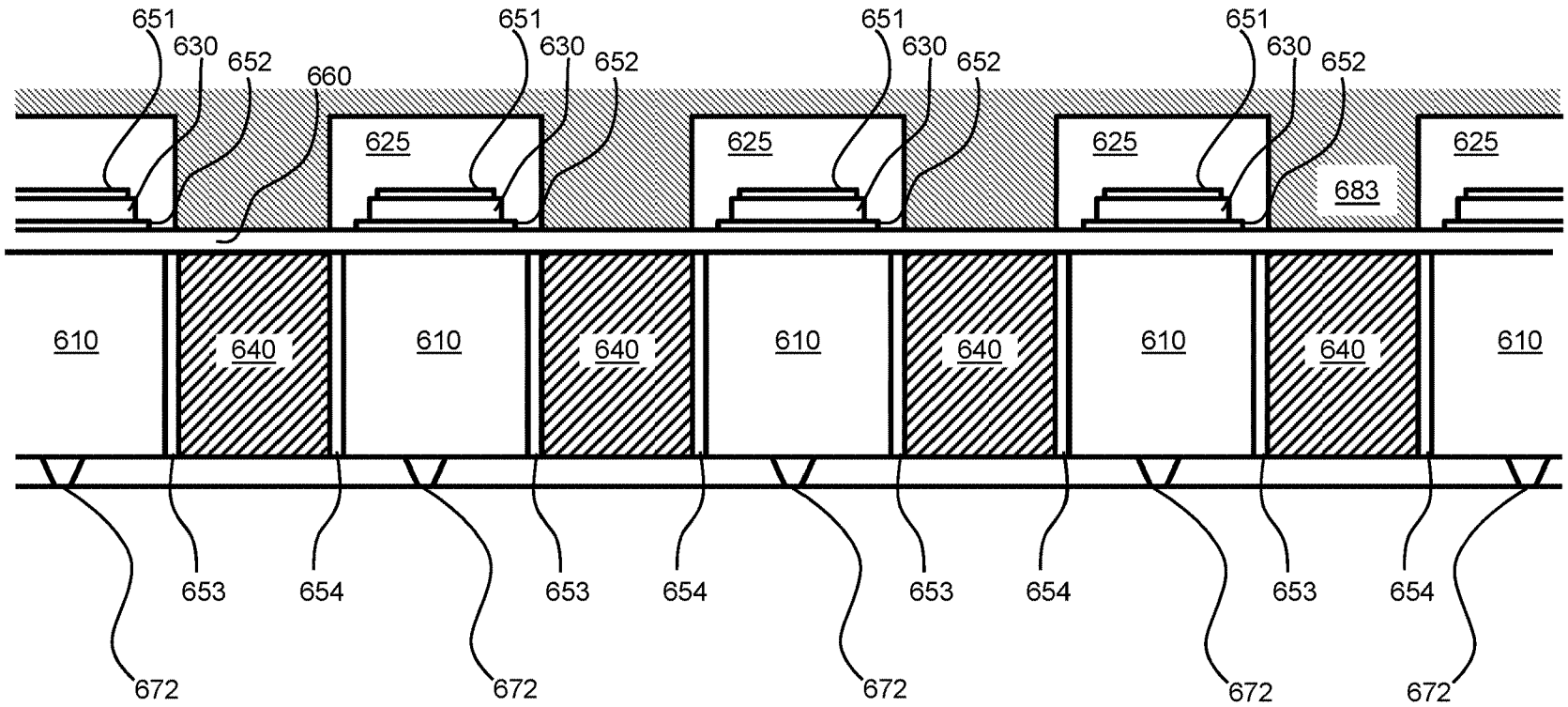
FIG. 9 is a cross-sectional view of an actuator component for a droplet deposition head according to a still further example embodiment that is of a thin-film/MEMS-type.

In the actuator component of FIG. 9, a multiplicity of fluid chambers 610 are provided side-by-side in an array. Each fluid chamber is provided with a nozzle 672 formed in a nozzle layer 670, from which fluid contained within the chamber 610 may be ejected, in a manner that will be described below. Accordingly, all of the fluid chambers 610 in FIG. 9 may be characterized as being "firing" chambers. Each of the fluid chambers 610 is elongate in a chamber length direction, which is into the page in FIG. 9.

On an opposing side of each chamber 610 to the nozzle layer 670, there is provided a vibration plate 660. The vibration plate 660 is deformable to generate pressure fluctuations in the fluid chamber 610, such that fluid may be ejected from the fluid chamber 610 via the nozzle 672.

The vibration plate 660 may comprise any suitable material, such as, for example a metal, an alloy, a dielectric material and/or a semiconductor material. Examples of suitable materials include silicon nitride ($Si_3N_4$), silicon dioxide ($SiO_2$), aluminum oxide ($Al_2O_3$), titanium dioxide ($TiO_2$), silicon (Si) or silicon carbide (SiC). The vibration plate 660 may additionally or alternatively comprise multiple layers.

The actuator component further includes a multiplicity of piezoelectric actuating elements 630 provided on the vibration plate 660. A respective piezoelectric actuating element 630 is provided for each fluid chamber 610, with the piezoelectric actuating element 630 for a particular fluid chamber 610 being configured to deform the vibration plate 660. The actuator component of FIG. 9 may therefore be characterized as operating in roof mode.

The piezoelectric actuating element 630 may, for example, comprise lead zirconate titanate (PZT); however any suitable piezoelectric material may be used.

Each piezoelectric actuating element 630 is provided with a first actuation electrode 651 and a second actuation electrode 652. The second actuation electrode 652 is provided on one side of the piezoelectric actuating element 630, between the piezoelectric actuating element 630 and the vibration plate 660. The first actuation electrode 651 is provided on the opposing side of the piezoelectric actuating element 630.

The piezoelectric actuating element 630 may be provided on the second actuation electrode 652 using any suitable deposition technique. For example, a sol-gel deposition technique may be used to deposit successive layers of piezoelectric material to form the piezoelectric actuating element 630 on the second actuation electrode 652.

The first and second actuation electrodes 651, 652 may comprise any suitable material e.g. iridium (Ir), ruthenium (Ru), platinum (Pt), nickel (Ni) iridium oxide (Ir2O3), Ir2O3/Ir and/or gold (Au). The first and second actuation electrodes 651, 652 may be formed using any suitable technique, such as a sputtering technique.

The first and second actuation electrodes 651, 652 and the piezoelectric actuating element 630 may be patterned separately or in the same processing step.

When a drive waveform is applied by the first and second actuation electrodes 651, 652 to the piezoelectric actuating element 630, a stress is generated in the piezoelectric actuating element 630, causing the piezoelectric actuating element 630 to deform on the vibration plate 660. This deformation changes the volume within the fluidic chamber 610 and fluid droplets may be discharged from the nozzle 672 by driving the piezoelectric actuating element 630 with an appropriate drive waveform.

As a result, the actuator component of FIG. 9 is able to increase the pressure of the fluid within selected firing chambers 610, hence causing droplet ejection from these selected chambers. This selection may vary in dependence upon the input data received by the droplet deposition head of which the actuator component forms a part.

A wiring layer (not shown) comprising electrical connections may also be provided on the vibration plate 660, whereby the wiring layer may comprise two or more electrical traces for example, to connect the first and second actuation electrodes 651, 652 to voltage signals, or to ground.

The actuator component of FIG. 9 further includes a capping substrate 683 that is attached to the vibration plate. The capping substrate 683 provides a number of actuator chambers 625, each of the piezoelectric actuating elements 630 being enclosed within a respective one of the actuator chambers 625.

As may be seen from FIG. 9, adjacent firing chambers 610 are separated by non-actuable walls 640 comprising piezoelectric material (such as lead zirconate titanate (PZT), however any suitable piezoelectric material may be used). The firing chambers 610 and the non-actuable walls 640 may be provided by sawing or machining the chambers in a body of piezoelectric material. Alternatively, an etching process, such as deep reactive ion etching (DRIE) or chemical etching might be used.

As may be seen from FIG. 9, each non-actuable wall 640 is provided with a first 653 and a second 654 isolated electrode. The first 653 and second 654 isolated electrodes may more specifically be isolated from each other. In addition, they may be electrically isolated from traces (not shown) that connect the actuation electrodes 651, 652 to voltage signals, or to ground.

When the pressure of the fluid within a firing chamber 610 is increased (or decreased), whether as a result of the action of the actuable walls 630, or otherwise, the fluid will generally apply a corresponding fluid force to the walls of that firing chamber 610. When such a fluid force is applied to a non-actuable wall 640, as a result of the electrical isolation of the isolated electrodes 653, 654, a charge is induced in each of the isolated electrodes 653, 654. These induced charges, because they cannot leave the isolated electrodes 653, 654, result in an electric field being applied to the non-actuable wall 640, which in turn causes the piezoelectric material of the non-actuable wall 640 to apply a force in opposition to the fluid force.

This may result in less pressure being transmitted from the firing chamber 610 on one side of the non-actuable wall 640 to the firing chamber 610 on the other side of the non-actuable wall 640.

The non-actuable walls 640 may thus be "stiffer", as a result of the provision of the isolated electrodes 653, 654. As a result, the non-actuable walls 640 may not transmit significant forces to the surrounding portions of the actuator component 600, such as the vibration plate 660, the capping substrate 683, or the nozzle layer 670.

This may, for example, mean that there is less interference or "crosstalk" between nearby firing chambers 610 when they are actuated at the same time (or substantially the same time) to eject droplets.

It should be appreciated, from the above description of the actuator component of FIG. 9, that to make use of non-actuable walls with isolated electrodes as described above with reference to the actuator components of FIGS. 1-9, it is by no means essential that the piezoelectric actuating elements are configured as actuable walls, as is the case in the actuator components of FIGS. 1-8.

More generally, it will be appreciated that there are a variety of suitable constructions of a piezoelectric actuating element and its first and second actuation electrodes, where the first and second actuation electrodes for the piezoelectric actuating element are configured to apply a drive waveform to the piezoelectric actuating element, which is thereby deformed, thus causing droplet ejection.

Similarly, in view of the number of different actuator components for droplet deposition heads described above, it will be appreciated that there are a variety of suitable configurations of a non-actuable wall and its first and second isolated electrodes, where the first and second isolated electrodes are electrically isolated so that, when fluid within one of the at least one of said firing chambers bounded by that non-actuable wall applies a force to that non-actuable wall, a charge is induced in the isolated electrodes, thereby causing the piezoelectric material of that non-actuable wall to apply a force in opposition to the fluid force.

It should be appreciated that, as specifically noted above with regard to the actuator component of FIGS. 1 and 2, a droplet deposition head of which one of the actuator components shown in FIGS. 1-8 forms a part may additionally include various other components. For instance, such droplet deposition heads may include one or more manifold components that are attached to the actuator component and that convey fluid to the fluid chambers within the array. Such manifold components typically connect to a fluid supply system (e.g. an ink supply system in the case where the head is an inkjet printhead).

In some examples, manifold component(s) might supply fluid at only one longitudinal end of each chamber (in which case, the other end could be sealed) or they may supply fluid at both ends. Furthermore, manifold component(s) may receive fluid from the fluid chambers within said array; for instance, the manifold component(s) may supply fluid to one longitudinal end of each chamber and receive fluid from the other longitudinal end.

Such droplet deposition heads may, in addition (or perhaps instead), include drive circuitry (for instance in the form of one or more integrated circuits, such as ASICs) that is electrically connected to the actuating elements, for example by means of electrical traces provided by the actuator component. Such drive circuitry may supply drive voltage signals to the actuating elements that cause the ejection of droplets from a selected group of chambers, with the selected group changing with changes in input data received by the head.

It should be noted that the foregoing description is intended to provide a number of non-limiting examples that assist the skilled reader's understanding of the present invention and that demonstrate how the present invention may be implemented. Other examples and variations are contemplated within the scope of the appended claims.

The invention claimed is:

1. An actuator component for a droplet deposition head comprising:

a plurality of fluid chambers arranged side-by-side in an array, which extends in an array direction, at least some of said fluid chambers being firing chambers, each of which is provided with at least one piezoelectric actuating element and a nozzle, said at least one piezoelectric actuating element being actuable to cause droplet ejection from said nozzle; and a plurality of non-actuable walls, each of which comprises piezoelectric material and bounds, in part, at least one of said firing chambers;

wherein:

each of said piezoelectric actuating elements is provided with at least a first and a second actuation electrode, the first and second actuation electrodes for each piezoelectric actuating element being configured to apply a drive waveform to that piezoelectric actuating element, which is thereby deformed, thus causing droplet ejection; and each of said non-actuable walls is provided with at least a first and a second isolated electrode, the first and second isolated electrodes for each non-actuable wall being electrically isolated so that, when fluid within one of the at least one of said firing chambers bounded by that non-actuable wall applies a force to that non-actuable wall, a charge is induced in the isolated electrodes, thereby causing the piezoelectric material of that non-actuable wall to apply a force in opposition to the fluid force.

2. The actuator component of claim 1, wherein:

some of said fluid chambers are non-firing chambers, each of which is configured such that it is unable to eject droplets; and said non-firing chambers are provided alternately with said firing chambers in said array direction.

3. The actuator component of claim 2, wherein:

each of said non-firing chambers is configured such that it is not provided with a nozzle for droplet ejection;

and/or it is sealed, so as to prevent fluid from entering.

4. The actuator component of claim 2, wherein:

each of said plurality of fluid chambers is elongate in a chamber length direction; and said non-firing chambers are offset from said firing chambers in a direction perpendicular to said array direction and to said chamber length direction.

5. The actuator component of claim 1, wherein:

substantially all of said fluid chambers are firing chambers; and said piezoelectric actuating element is configured as an actuable wall, which comprises piezoelectric material and bounds, in part, at least one of said firing chambers, the actuator component therefore comprising a plurality of actuable walls.

6. The actuator component of claim 5, wherein:

each of said non-actuable walls separates two of said plurality of fluid chambers; and each of said non-actuable walls separates two of said firing chambers.

7. The actuator component of claim 6, wherein:

each of said non-actuable walls has a first side adjacent one of the two fluid chambers separated by that non-actuable wall and a second side adjacent the other of the two fluid chambers separated by that non-actuable wall; and said first and second isolated electrodes are disposed respectively on the first and second sides of the corresponding actuable walls.

8. The actuator component of claim 5, wherein:

each of said actuable walls separates two of said plurality of fluid chambers; and each of said actuable walls separates two of said firing chambers.

9. The actuator component of claim 5, wherein said actuable walls are interspersed with said non-actuable walls.

10. The actuator component of claim 9, wherein said actuable walls and said non-actuable walls are provided alternately.

11. The actuator component of claim 5, wherein the thickness in the array direction of each non-actuable wall is greater than the thickness of each actuable wall.

12. The actuator component of claim 1, further comprising a plurality of drive traces for enabling electrical connection to drive circuitry, said drive traces extending away from the actuation electrodes so as to enable electrical connection to drive circuitry; and a plurality of ground traces, each of said ground traces extending away from a respective one of said actuation electrodes so as to enable electrical connection to ground;

wherein:

each of said drive traces extends to a respective electrical connector from a respective one of said first actuation electrodes, said electrical connectors being configured to connect to an electrical flex, which provides electrical connection to drive circuitry;

each of said ground traces extends from a respective one of said second actuation electrodes; and said isolated electrodes are electrically isolated from said traces.

13. A droplet deposition head comprising an actuator component comprising:

a plurality of fluid chambers arranged side-by-side in an array, which extends in an array direction, at least some of said fluid chambers being firing chambers, each of which is provided with at least one piezoelectric actuating element and a nozzle, said at least one piezoelectric actuating element being actuable to cause droplet ejection from said nozzle; and a plurality of non-actuable walls, each of which comprises piezoelectric material and bounds, in part, at least one of said firing chambers;

wherein:

each of said piezoelectric actuating elements is provided with at least a first and a second actuation electrode, the first and second actuation electrodes for each piezoelectric actuating element being configured to apply a drive waveform to that piezoelectric actuating element, which is thereby deformed, thus causing droplet ejection; and each of said non-actuable walls is provided with at least a first and a second isolated electrode, the first and second isolated electrodes for each non-actuable wall being electrically isolated so that, when fluid within one of the at least one of said firing chambers bounded by that non-actuable wall applies a force to that non-actuable wall, a charge is induced in the isolated electrodes, thereby causing the piezoelectric material of that non-actuable wall to apply a force in opposition to the fluid force.

14. The droplet deposition head of claim 13, wherein:

substantially all of said fluid chambers are firing chambers; and said piezoelectric actuating element is configured as an actuable wall, which comprises piezoelectric material and bounds, in part, at least one of said firing chambers, the actuator component therefore comprising a plurality of actuable walls.

15. The droplet deposition head of claim 14, wherein:

each of said actuable walls separates two of said plurality of fluid chambers; and each of said actuable walls separates two of said firing chambers.

16. The droplet deposition head of claim 14, wherein said actuable walls are interspersed with said non-actuable walls.

17. The droplet deposition head of claim 14, wherein:

each of said non-actuable walls separates two of said plurality of fluid chambers; and each of said non-actuable walls separates two of said firing chambers.

18. The droplet deposition head of claim 17, wherein:

each of said non-actuable walls has a first side adjacent one of the two fluid chambers separated by that non-actuable wall and a second side adjacent the other of the two fluid chambers separated by that non-actuable wall; and said first and second isolated electrodes are disposed respectively on the first and second sides of the corresponding actuable walls.

19. The droplet deposition head of claim 13, wherein:

some of said fluid chambers are non-firing chambers, each of which is configured such that it is unable to eject droplets; and said non-firing chambers are provided alternately with said firing chambers in said array direction.

20. The droplet deposition head of claim 19, wherein each of said non-firing chambers is configured such that: it is not provided with a nozzle for droplet ejection; and/or it is sealed, so as to prevent fluid from entering.

* * * * *